US006936388B2

(12) United States Patent
Suzuki et al.

(10) Patent No.: US 6,936,388 B2
(45) Date of Patent: Aug. 30, 2005

(54) ELECTROPHOTOGRAPHIC PHOTORECEPTOR, AND IMAGE FORMING METHOD, IMAGE FORMING APPARATUS, AND IMAGE FORMING APPARATUS PROCESSING UNIT USING SAME

(75) Inventors: Tetsuro Suzuki, Shizuoka (JP); Kazukiyo Nagai, Shizuoka (JP); Nozomu Tamoto, Shizuoka (JP); Eiji Kurimoto, Shizuoka (JP); Hidetoshi Kami, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 40 days.

(21) Appl. No.: 10/103,791

(22) Filed: Mar. 25, 2002

(65) Prior Publication Data

US 2003/0077531 A1 Apr. 24, 2003

(30) Foreign Application Priority Data

| | | |
|---|---|---|
| Mar. 23, 2001 | (JP) | 2001-084645 |
| Mar. 23, 2001 | (JP) | 2001-084942 |
| Apr. 24, 2001 | (JP) | 2001-125371 |
| Feb. 19, 2002 | (JP) | 2002-040962 |
| Feb. 26, 2002 | (JP) | 2002-050316 |

(51) Int. Cl.[7] ..... G03G 5/147
(52) U.S. Cl. ..... 430/66; 430/67; 399/159
(58) Field of Search ..... 430/66, 67; 399/159

(56) References Cited

U.S. PATENT DOCUMENTS

| | | | | | |
|---|---|---|---|---|---|
| 4,203,764 | A | * | 5/1980 | Tosaka et al. | 430/67 |
| 4,387,148 | A | * | 6/1983 | Franke et al. | 430/66 |
| 4,740,441 | A | | 4/1988 | Otomura | |
| 4,942,104 | A | | 7/1990 | Kitajima et al. | |
| 5,028,502 | A | | 7/1991 | Yuh et al. | |
| 5,100,453 | A | | 3/1992 | Richards | |
| 5,339,138 | A | | 8/1994 | Mishima et al. | |
| 5,391,449 | A | * | 2/1995 | Maruyama et al. | 430/66 |
| 5,411,827 | A | | 5/1995 | Tamura et al. | |
| 5,496,671 | A | | 3/1996 | Tamura et al. | |
| 5,578,405 | A | | 11/1996 | Ikegami et al. | |
| 5,702,855 | A | | 12/1997 | Ikegami et al. | |
| 5,723,243 | A | | 3/1998 | Sasaki et al. | |
| 5,747,204 | A | | 5/1998 | Anzai et al. | |
| 5,789,128 | A | | 8/1998 | Adachi et al. | |
| 5,834,145 | A | | 11/1998 | Yoshinaga et al. | |
| 5,840,454 | A | | 11/1998 | Nagai et al. | |
| 5,846,680 | A | | 12/1998 | Adachi et al. | |
| 5,910,561 | A | | 6/1999 | Adachi et al. | |
| 5,928,828 | A | | 7/1999 | Suzuki | |
| 5,942,363 | A | | 8/1999 | Tanaka et al. | |
| 5,976,746 | A | | 11/1999 | Tanaka et al. | |
| 5,999,773 | A | | 12/1999 | Yasutomi et al. | |
| 6,026,262 | A | | 2/2000 | Kinoshita et al. | |
| 6,027,846 | A | | 2/2000 | Shimada et al. | |
| 6,030,736 | A | | 2/2000 | Ikegami et al. | |
| 6,045,959 | A | | 4/2000 | Katayama et al. | |
| 6,060,201 | A | | 5/2000 | Kinoshita et al. | |
| 6,066,428 | A | | 5/2000 | Katayama et al. | |
| 6,069,224 | A | | 5/2000 | Adachi et al. | |
| 6,093,784 | A | | 7/2000 | Tamura et al. | |
| 6,120,960 | A | | 9/2000 | Aoki et al. | |
| 6,136,483 | A | | 10/2000 | Suzuki et al. | |
| 6,187,492 | B1 | | 2/2001 | Ri et al. | |
| 6,187,494 | B1 | | 2/2001 | Kawamura et al. | |
| 6,191,249 | B1 | | 2/2001 | Tanaka et al. | |
| 6,210,848 | B1 | | 4/2001 | Nagai et al. | |
| 6,221,549 | B1 | | 4/2001 | Emoto et al. | |
| 6,228,550 | B1 | | 5/2001 | Matsuda et al. | |
| 6,249,304 | B1 | | 6/2001 | Sawayama et al. | |
| 6,255,028 | B1 | | 7/2001 | Hasegawa et al. | |
| 6,303,257 | B1 | | 10/2001 | Hasgawa et al. | |
| 6,319,878 | B1 | | 11/2001 | Ina et al. | |
| 6,322,940 | B1 | | 11/2001 | Nishigaki et al. | |
| 6,326,112 | B1 | | 12/2001 | Tamura et al. | |
| 6,335,137 | B1 | | 1/2002 | Suzuki et al. | |
| 6,366,751 | B1 | | 4/2002 | Shakuto et al. | |
| 6,403,275 | B1 | | 6/2002 | Kuramoto et al. | |
| 6,432,590 | B1 | | 8/2002 | Ueda et al. | |
| 6,432,596 | B2 | | 8/2002 | Ikuno et al. | |
| 6,444,387 | B2 | | 9/2002 | Ri et al. | |
| 6,468,706 | B2 | | 10/2002 | Matsuda et al. | |
| 2003/0073015 | A1 | * | 4/2003 | Tamoto et al. | 430/66 |

FOREIGN PATENT DOCUMENTS

| | | | | |
|---|---|---|---|---|
| JP | 56-48637 | | 5/1981 | |
| JP | 64-1728 | | 1/1989 | |
| JP | 4-281461 | | 10/1992 | |
| JP | 5-216250 | | 8/1993 | |
| JP | 06161138 | A * | 6/1994 | G03G/5/147 |
| JP | 8-248666 | | 9/1996 | |
| JP | 8-292585 | | 11/1996 | |
| JP | 2000-98644 | | 4/2000 | |

OTHER PUBLICATIONS

Borsenberger, et al. Organic Photoreceptors for Imaging Systems. New York: Marcel–Dekker, Inc. (1993) pp. 6–17.*
U.S. Appl. No. 10/803,256, filed Mar. 19, 2004, Kami.
U.S. Appl. No. 10/787,299, filed Feb. 27, 2004, Nagame et al.
U.S. Appl. No. 10/769,855, filed Feb. 3, 2004, Watanabe et al.
U.S. Appl. No. 10/703,447, filed Nov. 10, 2003, Yoshiyuki et al.
U.S. Appl. No. 10/726,669, filed Dec. 4, 2003, Kotsugai et al.

* cited by examiner

*Primary Examiner*—Christopher Rodee
(74) *Attorney, Agent, or Firm*—Oblon, Spivak, McClelland, Maier & Neustadt, P.C.

(57) ABSTRACT

An electrophotographic photoreceptor in which at least a photosensitive layer is provided above an electroconductive substrate, the outermost surface layer of the electroconductive substrate contains at least an inorganic filler, a binder resin, and an aliphatic polyester, or, alternatively, the outermost surface layer of the electroconductive substrate contains at least an inorganic filler and a binder resin and the binder resin is a copolymer polyarylate having an alkylene-arylcarboxylate structural unit, also an image forming method, image forming apparatus, and image forming apparatus processing unit in which the electrophotographic photoreceptor is used.

13 Claims, 4 Drawing Sheets

ELECTROPHOTOGRAPHIC PHOTORECEPTOR, AND IMAGE FORMING METHOD, IMAGE FORMING APPARATUS, AND IMAGE FORMING APPARATUS PROCESSING UNIT USING SAME

BACKGROUND OF THE INVENTION

1. Field of the Invention

This invention relates to an electrophotographic photoreceptor which exhibits high durability and produces high quality images over a long period of time. The present invention also relates to an image forming method, image forming apparatus, and image forming apparatus processing unit.

2. Description of the Related Art

An electrophotographic method employed in copiers, fax machines, and laser printers and the like generally utilizes methods comprising a process represented by charging an electrographic photoreceptor, irradiating images, developing, followed by transferring a toner image to an image bearing member (transfer paper), fixing the toner image, and cleaning the surface of electrophotographic photoreceptor. In a number of fundamental characteristics required to be an electrophotographic photoreceptor utilizing such electrophotographic methods, for instance, (A) ability to charge a certain level of electrical potential in a dark environment, (B) small electrical charge dissipation in a dark environment, and (C) quick dissipation of electrical charge by light irradiation, may be mentioned besides having long-term reliability of image quality, low environmental impact, and low cost. The photoreceptors used conventionally in electrophotographic schemes include such commonly known methods for instance, a photoconductive layer mainly comprising selenium or a selenium alloy disposed on an electroconductive substrate, inorganic photoconductive material such as zinc oxide or cadmium sulfide dispersed in a binder, and utilizing amorphous silicon based material. However, more recently, organic photoreceptors have acquired a wide use for their cost efficiency, freedom of designing photoreceptors, and for their low environmental impact.

Among organic electrophotographic photoreceptors, photoconductive resins represented by polyvinyl carbazol (PVK), charge mobile complex types represented by PVK-TNF (2,4,7-trinitrofluorolenone), pigment dispersion types represented by phthalocyanine binders, and multi functions that use an electrical charge generating substance and electrical charge transporting substance in combination are known. Specifically, a function-separating type photoreceptors are particularly outstanding in terms of sensitivity, durability, and stability.

The latent electrostatic image formation mechanism of these function-separating type photoreceptors is as follows. When light irradiated after charging the photoreceptor, the light passes through the transparent electrical charge transporting layer and is absorbed by the electrical charge generating substance in the electrical charge generating layer, the electrical charge generating substance which absorbed light generates charge carriers, then, the charge carriers are injected into the electrical charge transporting layer, and moved in the electrical charge transporting layer along an electric field generated by the charging, and a latent electrostatic image is formed by the neutralization of the electrical charge on the photoreceptor surface. In a function-separating type photoreceptor, the use of a combination of an electrical charge transporting substance having high mobility and mainly absorbing the ultraviolet portion and an electrical charge generating substance having high molecular efficiency and absorbing mainly the visible portion is known and useful.

However, most of the organic electrical charge transporting substances intended for use in organic electrophotographic photoreceptors utilizing an electrophotographic method are low molecular-weight compounds, which do not form films when used alone, and therefore, they are usually used as mixtures and dispersants of inactive polymer. However, electrical charge transporting layers comprising a low molecular-weight electrical charge transporting substance and an inactive polymer are generally soft, and accordingly, suffer shortcomings such as easy ware out by mechanical load exerted on the surface of the photoreceptor due to the developing system or cleaning system used repeatedly in an electrophotographic process. Actually, the thickness of the photoreceptor film decreases due to wear (hereinafter called film erosion), thereby sensitivity deteriorates and charging properties deteriorate, image density reduces, abnormal images are produced due to texture smudging and the like, and leads to shorten a life of photoreceptor, making replacement necessary.

In recent years, as image forming apparatuses have become increasingly smaller, progress have been made in making diameters of photoreceptors smaller, as well as trend towards higher machine speeds and for realizing maintenance-free operation created a strong demand for producing highly durable photoreceptors. In order to achieve higher durability, the first target is to improve wear resistance, as mentioned earlier. Examples in the art regarding this purpose include (1) use of hardening binder in a surface layer (Japanese Patent Application Laid-Open No. S56-48637/1981), (2) improvement made in binder resin of the photoconductive member (Japanese Patent Application Laid-Open No. H5-216250 and 2000-98644), (3) use of polymer type electrical charge transporting substance (Japanese Patent Application Laid-Open No. S64-1728/1989 (published), and (4) dispersing an inorganic filler in the surface layer (Japanese Patent Application Laid-Open No. H4-281461/1992 (published).

Of these foregoing arts, (1) the art that uses a hardening binder, because of poor miscibility with the electrical charge transporting substance, there are impurities such as polymerization starters and unreacted residual groups, due to which the electric potential in the exposed portion rises and image density decreases. (2) as method of improving the binder resin, usage of polyester resin containing an alkylene terephthalate structural unit maybe mentioned. However, such method derives new issues such as occurrence of toner filming caused by lowered softening temperature, deterioration in solubility to coating solvents, in addition to unattained improvement in resistance to wear which attributes to composition ratio of the low molecular electrical charge transporting substance. And with (3), by utilizing a polymer type electrical charge transporting substance, some degree of improvement in wear resistance may be realized, durability is not sufficient, and there are manufacturing difficulties such as material polymerization and in refining, thus high purity is difficult to achieve, and moreover, high viscosity in coating liquid. With (4), an inorganic filler used as dispersion, as compared to a photoreceptor which uses an ordinary low molecular-weight electrical charge transporting substance dispersed in an inactive polymer, has high durability and the electrical characteristics in repeated use is maintained, thereby given some attention.

Nevertheless, photoreceptors dispersed on its surface layer with an inorganic filler suffers such shortcomings as image smearing caused by oxidizing gasses such as ozone and Nox derived from electrical charger and the like during the repeated use. This phenomenon is caused by several factors. The latent image on the photoreceptor surface formed by charging-exposure diffuses, and triggers electric potential contrast to decline, and causes image smearing. Such image smearing appears in the developed toner image as a thickening of written characters and thin lines, a deterioration in resolution, and lack of density in intermediate tones. In notable cases written characters and drawings are indistinguishable. Hence image smearing is a phenomenon caused by decrease in resistance of the photoreceptor surface. Image smearing in a photoreceptor dispersed with an inorganic filler is believed to be caused by a number of factors. For instance, due to dispersion of the inorganic filler, durability is improved, thereby the renewal of the photoreceptor surface due to erosion cannot keep up with the permeation of the oxidizing gases. Another instance is that toner and paper dust produces a so called filming on the irregularities built up on the surface due to inorganic filler dispersion, to which the oxidizing gases adhere. Third instance is that non-insulative fillers or surface treated filters are used to stabilize the electrical properties, thereby the resistance of the surface layer is weakened. As measure for preventing such image smearing during repeated use, there are methods such as preventing moisture adherence by warming the photoreceptor with a heater, or releasing the oxidizing gases. However, these methods cause problems, in that they are time consuming at the start up of the equipment and require large energy.

Another measure is the method of adding an antioxidant to the surface layer (Japanese Patent Application Laid-Open No. H8-292585/1996 (published)), but there is a little effect in adding only a small amount, and electrical characteristics deteriorate when a large amount is added. There is also a method in which a polyarylate resin is contained in a surface layer binder resin (Japanese Patent Application Laid-Open No. H8-248666/1996 (published)), however, performance do not reach the level of satisfaction using ordinary polyarylate resins consisting of a single component as of present. To date, no means have been found for satisfactorily resolving the problem of image smearing during repeated use.

SUMMARY OF THE INVENTION

An object of the present invention is to provide high-performance electrophotographic photoreceptors subject to repeated use, demonstrates high durability, in which good images are continuously obtained. Another object is to provide an image forming method, image forming apparatus, and image forming apparatus processing unit that are small in size and in which high-speed printing is possible using these electrophotographic photoreceptors.

The first aspect of the present invention provides An electrophotographic photoreceptor comprising, an electroconductive substrate, and a photosensitive layer disposed above the electroconductive substrate, in which an outermost surface layer of the electrophotographic photoreceptor contains an inorganic filler, binder resin, and aliphatic polyester.

The second aspect of the present invention provides an electrophotographic photoreceptor comprising an electroconductive substrate, and a photosensitive layer disposed above the electroconductive substrate, in which an outermost surface layer of the electrophotographic photoreceptor contains an inorganic filler and a copolymer polyarylate resin having an alkylene-aryldicarboxylate structural unit as a binder resin.

Further, the third aspect of the present invention provides an image forming method comprising various steps which includes a step for charging a electrophotographic photoreceptor, a step for irradiating the electrophotographic photoreceptor charged in the step for charging so as to form a latent electrostatic image, a step for developing the latent electrostatic image using a developer, and a step for transferring the developed image formed by the step for developing to a recording material and the electrophotographic photoreceptor has at least one photosensitive layer on an electroconductive substrate, and an outermost surface layer of the electrophotographic photoreceptor contains at least an inorganic filler, and also contains one of (1) a binder resin and an aliphatic polyester, and (2) a binder resin containing a polyarylate having alkylene-aryldicarboxylate structural unit.

Moreover, the fourth aspect of the present invention provides an image forming apparatus comprising an electrophotographic photoreceptor, charger for charging the electrophotographic photoreceptor, light irradiator for irradiating the electrophotographic photoconductor charged by the charger so as to form a latent electrostatic image, image developer for developing the latent electrostatic image using a developer so as to form a developed image, and transfer for transferring the developed image formed by the image developer to a recording material, and the electrophotographic photoreceptor has at least one photosensitive layer on an electroconductive substrate, and an outermost surface layer of the electrophotographic photoreceptor contains at least an inorganic filler, and also contains one of (1) a binder resin and an aliphatic polyester, and (2) a binder resin containing a polyarylate having alkylene-aryldicarboxylate structural unit.

And the final aspect of the present invention provides a processing unit for an image forming apparatus, comprising an electrophotographic photoreceptor, and a means selected from such means as (a) charging the electrophotographic photoreceptor, (b) developing a latent electrostatic image using a developer so as to form a developed image, and (c) transferring the developed image formed by the image developer to a recording material, (d) cleaning the developer remaining on the electrophotographic photoreceptor after the transferring, and (e) removing the latent image on the electrophotographic photoreceptor after the transferring, and the processing unit is detachable, wherein the electrophotographic photoreceptor has at least one photosensitive layer on an electroconductive substrate, and an outermost surface layer of the electrophotographic photoreceptor contains at least an inorganic filler, and also contains one of (1) a binder resin and an aliphatic polyester, and (2) a binder resin containing a polyarylate having alkylene-aryldicarboxylate structural unit.

BRIEF DESCRIPTION OF THE DRAWINGS

FIG. 5 is a cross-sectional view representing one example of the electrophotographic photoreceptor of the present invention having a configuration in which an electrical charge transporting layer 37 mainly comprise of an electrical charge transporting substance and an electrical charge generating layer 35 mainly comprised of an electrical charge generating substance are formed on an electroconductive substrate 31, and a protective layer 39 is formed on the electrical charge generating layer 35.

FIG. 6 is a schematic cross-sectional view representing one example of the image forming apparatus of the present invention.

FIG. 7 is a schematic view representing one example of an image forming apparatus processing unit.

DESCRIPTION OF THE PREFERRED EMBODIMENTS

<Electrophotographic Photoreceptor>

Figure 1:
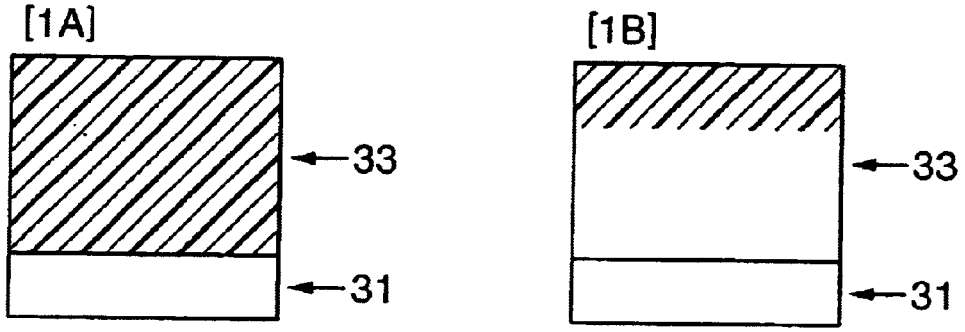
FIG. 1 and FIG. 2 are cross-sectional views representing one example of the electrophotographic photoreceptor of the present invention in which a photosensitive layer 33 mainly comprised of an electrical charge generating substance and an adhesive resin is disposed on an electroconductive substrate 31.

The electrophotographic photoreceptor of the present invention is an electrophotographic photoreceptor in which at least a photosensitive layer is disposed above a photo conducting support material, the outermost surface layer of the photosensitive layer contains at least an inorganic filler and a binder resin, or an inorganic filler and a binder resin, and the binder resin is a polyarylate having alkylene-aryldicarboxylate structural unit.

<Theory>

In the present invention it was discovered that, by using a photoreceptor in which the outermost surface layer thereof contains at least an inorganic filler, a binder resin, and an aliphatic polyester, or by using the same in which the binder resin is a polyarylate having alkylene-aryldicarboxylate structural unit, it was able to realize high durability, image smearing suppressed in repeated use, and good images continuously obtained. Although the reason for this is not clear, it is assumed as described below.

Concerning the former aspect, to begin with, one reason thereof is assumed that, by containing an aliphatic polyester, the manner in which the photoreceptor surface releases the toner or paper dust is improved, effective cleaning is carried out by the cleaning brush and/or cleaning blade, and toner and/or paper dust filming decreases.

Another reason is assumed to be that, because the aliphatic polyester exhibits strong affinity to inorganic filler, and particularly to an inorganic filler the periphery thereof is covered with any of various surface treating agents and/or an inorganic filler dispersant such as a polycarbonate compound, not only prevents the surface of the inorganic filler to adsorb oxidizing gases such as ozone and NOx produced by the charging process, but excess dispersant and/or surface treatment agent is removed from the inorganic filler and weakening of resistance in the vicinity of the inorganic filler is suppressed.

Concerning the latter aspect, to begin with, one reason thereof is assumed to be that, by using a polyarylate having alkylene-aryldicarboxylate structural unit, oxidizing gases such as ozone, NOx produced in the charging process permeating into en interior of the photoreceptor is suppressed, and weakening of resistance of the outermost surface layer dispersed with inorganic filler is suppressed.

Another reason thereof is assumed to be that, when the aliphatic polyester is contained, the polyarylate having alkylene-aryldicarboxylate structural unit exhibits strong affinity to the inorganic filler, and particularly to an inorganic filler in which periphery thereof is covered with any of various surface treating agents and/or an inorganic filler dispersant such as a polycarbonate compound, thereby, not only prevents adsorption on the surface of the inorganic filler, oxidizing gases such as ozone and NOx produced in the charging process, but excess dispersant and/or surface treatment agent is removed from the inorganic filler and weakening of resistance in the vicinity of the inorganic filler is suppressed.

Descriptions are given next of the inorganic fillers and binder resins of the present invention, and of the aliphatic polyester used in the outermost surface layer. The aliphatic polyester used in the present invention is synthesized by the ring opening polymerization of a cyclic ester, the polycondensation of an aliphatic dicarboxylic acid and an aliphatic diol, or the polycondensation of aliphatic ox carboxylic acid, with the first two processes mentioned being particularly effective. Aliphatic polyesters synthesized by the ring opening polymerization of a cyclic ester include the following.

COMPOUND 1

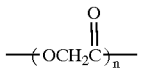

COMPOUND 2

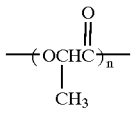

COMPOUND 3

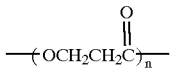

COMPOUND 4

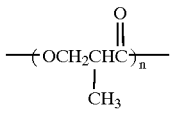

COMPOUND 5

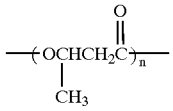

-continued

COMPOUND 6

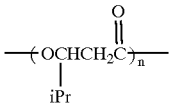

COMPOUND 7

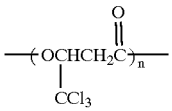

COMPOUND 8

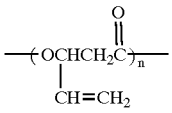

COMPOUND 9

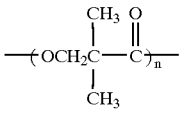

COMPOUND 10

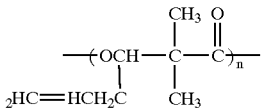

COMPOUND 11

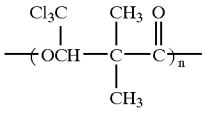

COMPOUND 12

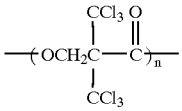

COMPOUND 13

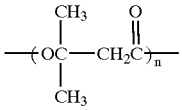

COMPOUND 14

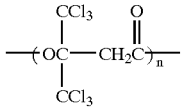

COMPOUND 15

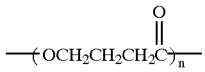

COMPOUND 16

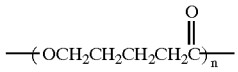

COMPOUND 17

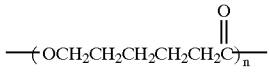

iPr: isopropyl

When the aliphatic polyester is synthesized by the polycondensation of an aliphatic dicarboxylic acid and an aliphatic diol, the aliphatic dicarboxylic acid may be oxalic acid, malonic acid, succinic acid, glutaric acid, adipic acid, β-methyladipic acid, pimelic acid, azelaic acid, sebacic acid, nonane dicarboxylic acid, decane dicarboxylic acid, undecane dicarboxylic acid, dodecane dicarboxylic acid, maleic acid, fumaric acid, citraconic acid, diglycolic acid, maleic acid, citric acid, and cyclohexane dicarboxylic acid or the like, with the use of mixtures of two or more types also permissible. The aliphatic diol may be ethylene glycol, propylene glycol, trimethylene glycol, butane-1,3-diol, 2,2-dimethylpropane-1,3-diol, 2-butene-1,4-diol, tetramethylene glycol, pentamethylene glycol, hexamethylene glycol, heptamethylene glycol, octamethylene glycol, nonamethylene glycol, decamethylene glycol, undecamethylene glycol, dodecamethylene glycol, tridecamethylene glycol, eicosamethylene glycol, diethylene glycol, or triethylene glycol or the like, with the use of mixtures of two or more types also permissible.

An aliphatic oxycarboxylic acid is a compound having the general equation

HO—R—COOH (where R is a straight chain or branch alkyl group).

More specific examples include 3-hydroxypropyl carboxylic acid, 4-hydroxybutyl carboxylic acid, 5-hydroxyamyl carboxylic acid, 6-hydroxyhexyl carboxylic acid, 7-hydroxyheptyl carboxylic acid, 8-hydroxyoctyl carboxylic acid, 9-hydroxynonyl carboxylic acid, and 10-hydroxydecyl carboxylic acid, which can also be used in mixture form.

For these aliphatic polyesters, everything from oligomers having a molecular weight of 1000 to polymers having a molecular weight of several hundreds of thousand may be used. When they are insoluble in organic solvents, they may be contained in the outermost surface layer by dispersion.

The amount of aliphatic polyester contained in the present invention is 0.01 to 100 parts by weight, and preferably 0.1 to 50 parts by weight, in respect to 100 parts by weight of inorganic filler.

A copolymer polyarylate resin for the binder resin used in the outermost surface layer with the inorganic filler of the present invention is now described.

An ordinary polyarylate resin refers to a polymer having the general formula III given below in which an arylene-aryldicarboxylate structural unit is repeated. For example, bisphenol A and terephthalic acid comprising the polyarylate resin having the structure IV may be mentioned.

General Formula III

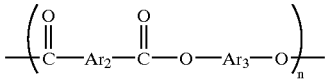

where $Ar_2$ and $Ar_3$ are allyl groups

Polyarylate resin IV

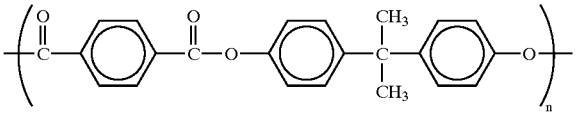

The copolymer polyarylate resin having the alkylene-aryldicarboxylate structural unit of the present invention is a resin containing the alkylene-aryldicarboxylate structural unit expressed by the general formula V below in the repeating structure of a polyarylate resin having the general formula III given above.

General Formula V

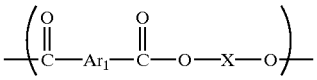

In this formula, $AR_1$ represents a substituent or non-substituent allyl group, and X a bivalent alkyl group, with a halogen atom or alkyl group indicated for the substituent group mentioned.

The alkylene-aryldicarboxylate structural unit of the general formula V above is derived from an aromatic dicarboxylic acid compound and a aliphatic diol compound or aliphatic cyclic ether compound.

Aromatic dicarboxylic acid components that configure the alkylene-aryldicarboxylate structural unit mentioned above are derived from aromatic dicarboxylic acid compounds such as isophthalic acid, terephthalic acid, tetrachlorophthalic acid, chlorophthalic acid, nitrophthalic acid, diphenyl-4,4'-dicarboxylic acid, diphenyl-3,3'-dicarboxylic acid, diphenylmethane-4,4'-dicarboxylic acid, 1,1-diphenylethane-4,4'-dicarboxylic acid, 2,2-diphenylpropane-4,4'-dicarboxylic acid, benzophenone-4,4'-dicarboxylic acid, naphthalene-1,4-dicarboxylic acid, naphthalene-1,5-dicarboxylic acid, naphthalene-2,6-dicarboxylic acid, naphthalene-2,7-dicarboxylic acid, diphenylether-4,4'-dicarboxylic acid, diphenylthioether-4,4'-dicarboxylic acid, and diphenyl sulfide-4,4'-dicarboxylic acid, which may be used in mixtures of two or more types. Among these, the use of terephthalic acid, isophthalic acid, and mixtures thereof is particularly effective.

Aliphatic diol components which configure the alkylene-aryldicarboxylate structural unit mentioned above are derived from aliphatic diol compounds such as ethylene glycol, 1,3-propane diol, 1,4-butane diol, 1,5-pentane diol, 1,6-hexane diol, 1,8-octane diol, 1,10-decane diol, 2-methyl-1,3-propane diol, 2,2-dimethyl-1,3-propane diol, 2-ethyl-1,3-propane diol, diethylene glycol, triethylene glycol, polyethylene glycols, and polytetramethylene ether glycols, or cyclic aliphatic diols such as 1,4-cyclohexane diol, 1,3-cyclohexane diol, and cyclohexane-1,4-dimethanol, which may be used in mixtures of two or more types. Among these, the use of ethylene glycol is particularly effective. The aliphatic cyclic ether compound ethylene oxide can also be used.

For the arylate structure of the copolymer polyarylate resin of the present invention, the structural unit represented by the general formula III given above may be cited, derived from aromatic dicarboxylic acid compounds and aromatic diol compounds.

The aromatic dicarboxylic acid component which comprises the arylate structure mentioned above is derived from the same compounds as is the aromatic dicarboxylic acid component which comprises the alkylene-aryldicarboxylate structural unit, with the use of terephthalic acid, isophthalic acid, and mixtures thereof being used particularly effectively..

The aromatic diol component which configures the arylate structure mentioned above is derived from 1,3-benzene diol, 1,4-benzene diol, 1,3-naphthalene diol, 1,2-naphthalene diol, 1,4-naphthalene diol, 1,7-naphthalene diol, 1,6-naphthalene diol, 1,5-naphthalene diol, 1,8-naphthalene diol, 2,3-naphthalene diol, 2,6-naphthalene diol, 2,7-naphthalene diol, 4,4'-dihydroxydiphenyl, 2,2'-dihydroxydiphenyl, 3,3'-dipropyl-4,4'-dihydroxydiphenyl, bis(4-hydroxyphenyl) methane, bis(4-hydroxyphenyl) phenyl methane, bis(4-hydroxyphenyl) diphenyl methane, 1,1-bis(hydroxyphenyl) ethane, 1,1-bis(4-hydroxyphenyl)-1-phenyl ethane, bisphenol A [2,2-bis(4-hydroxyphenyl) propane], 2,2-bis(3-methyl-4-hydroxyphenyl) propane, 2,2-bis(3-chloro-4-hydroxyphenyl) propane, 2,2-bis(3-bromo-4-hydroxyphenyl) propane 1,1-bis(4-hydroxyphenyl) propane, 1,1-bis(4-hydroxyphenyl) cyclohexane, cyclohexane, 1,1-bis(4-hydroxyphenyl) cyclopentane, 2,2-bis(3-phenyl-4-hydroxyphenyl) propane, 2,2-bis(3-isopropyl-4-hydroxyphenyl) propane, 2,2-bis(4-hydroxyphenyl) butane, 2,2-bis(3,5-dimethyl-4-hydroxyphenyl) propane, 2,2-bis(3,5-dibromo-4-hydroxyphenyl) propane, 4,4'-dihydroxydiphenyl sulfone, 4,4'-dihydroxydiphenyl sulfoxide, 4,4'-dihydroxydiphenyl sulfide, 3,3'-dimethyl-4,4'-jihydroxydiphenyl sulfide, 4,4'-dihydroxydiphenyl oxide, 2,2-bis(4-hydroxyphenyl) hexafluoropropane, 9,9-bis(4-hydroxyphenyl) fluorene, 9,9-bis(4-hydroxyphenyl) xanthene, and 1,3-bis(4-hydroxyphenyl)-tetramethyl disiloxane, which may be used in mixtures of two or more types. Among these, the use of a bisphenol is particularly effective, with the use of bisphenol A being especially effective.

In the copolymer polyarylate resin of the present invention, by combining the aromatic dicarboxylic acid component and aliphatic diol component comprising the alkylene-aryldicarboxylate structural unit with the aromatic dicarboxylic acid component and aromatic diol component comprising the arylate structure, copolymer polyarylate resins having the structure given below in general formula II are used effectively.

General Formula II

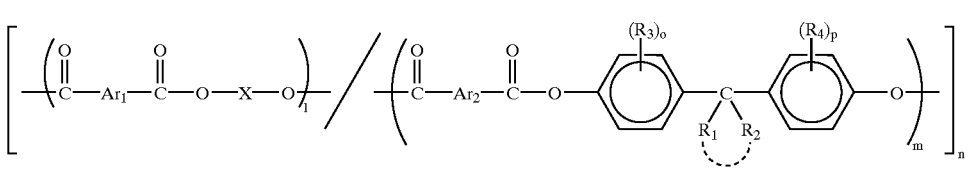

In this formula, $Ar_1$ and $Ar_2$ represent allyl groups which may have a substituent, the substituent group representing one of halogen atom and alkyl group, X represents a bivalent alkyl group, $R_1$ and $R_2$ may form a ring and respectively represents one of a hydrogen atom, an alkyl group, and an allyl group; $R_3$ and $R_4$ respectively represents one of a hydrogen atom, a halogen atom, and an alkyl group, with o and p represent integers from 1 to 4, which may be different in case the values are 2 or more; 1 and m are mol ratios fulfilling $0.05 \leqq 1 < 0.6$, $0.4 \leqq m < 0.95$, and $1+m=1$.

In the structure having the general formula II given above, it is particularly preferable that $Ar_1$ and $Ar_2$ be bivalent phenyl groups. In the general formula II, moreover, it is preferable that the bivalent alkyl group X be an ethylene group.

The ratio of the alkylene-aryldicarboxylate structural unit is subject to restriction depending on the photoreceptor manufacturing method and the environment in which it is used. When the alkylene-aryldicarboxylate structural unit ratio increases too much, the glass transition temperature and softening temperature falls, and problems such as toner filming occurs, which renders it unsuitable for a photoreceptor binder resin. When the alkylene-aryldicarboxylate structural unit ratio is too small, however, efficiency of the present invention in suppressing abnormal images in the face of oxidizing gases is not sufficiently achieved. The alkylene-aryldicarboxylate structural unit ratio relative to the total quantity of the copolymer polyarylate resin should be 3 to 60 wt. %, and preferably 5 to 40 wt. %. Expressed in terms of the repeating unit molar content ratio, the alkylene-aryldicarboxylate structural unit may be used for enhanced effect in a range of 5 to 60 mol %, and more preferably from 5 to 50 mol %. The best range for the glass transition temperature of the copolymer polyarylate resin of the present invention is 120° C. or greater but 170° C. or less. An effective range for the polystyrene equivalent weight average molecular weight of the copolymer polyarylate resin of the present invention preferably is $1\times10^4$ to $1\times10^5$ from the viewpoint of increased holding force of an inorganic filler, mechanical force of the resin itself, and the solubility of the resin.

For the method of manufacturing the copolymer polyarylate resin having the alkylene-aryldicarboxylate structural unit of the present invention, it is possible to employ a molten polymerization, solution polymerization, or interfacial polymerization method, using the respective dicarboxylic acid and diol compounds, or derivatives thereof, for deriving the alkylene-aryldicarboxylate structural unit and polyarylate structure. Of those, however, use of the interfacial polymerization process is particularly effective. A method of manufacture is also possible in which a molten kneading ester exchange reaction for an ordinary polyarylate resin comprising entirely of aromatic components and a polyester resin having an alkylene-aryldicarboxylate structure such as a polyethylene terephthalate is used.

The layer configuration of the electrophotographic photoreceptor of the present invention is not limited so long as at least a photosensitive layer is provided on the electroconductive substrate. Similarly, the components comprising the layers are not limited so long as either the outermost surface layer thereof contain at least an inorganic filler, a binder resin, and an aliphatic polyester or the outermost surface layer both contains at least an inorganic filler and a binder resin and the binder resin be a polyarylate having alkylene-aryldicarboxylate structural unit, and such can be suitably selected in accordance with the purpose. Example configurations of the electrophotographic photoreceptors of the present invention are shown in FIGS. 1 to 5. The electrophotographic photoreceptors used in the present invention are described below with reference to the drawings.

Figure 2:
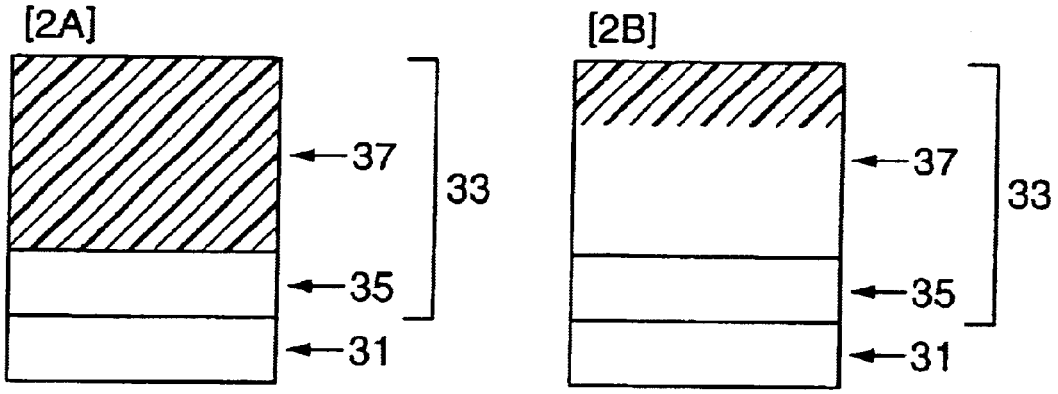

FIGS. 1 and 2 are cross-sectional views representing an electrophotographic photoreceptor of the present invention, in which a photosensitive layer 33 the main components comprised of an electrical charge generating substance and an adhesive resin disposed on an electroconductive substrate 31. The case in which the outermost surface layer that either contains an inorganic filler, binder resin, and aliphatic polyester, or contains an inorganic filler and a polyarylate having alkylene-aryldicarboxylate structural unit thereof occupies the entire photosensitive layer is shown in FIG. 1-A. The case in which the outermost surface layer occupies only the surface portion of the photosensitive layer is shown in FIG. 1-B. (In both of these figures the portion containing the inorganic filler, binder resin, and aliphatic polyester is represented by a dotted pattern.)

In FIG. 2, a configuration acquires an electrical charge generating layer 35 having an electrical charge generating substance as the main component and an electrical charge transporting layer 37 having an electrical charge transporting substance as the main component are formed on the electroconductive substrate 31. In FIG. 2-A, the outermost surface layer occupies the entire electrical charge transporting layer, whereas in FIG. 2-B, the outermost surface layer occupies the surface portion of the electrical charge transporting layer.

Figure 3:
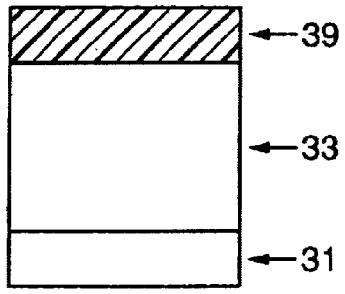
FIG. 3 through FIG. 5 are cross-sectional views representing one example of the electrophotographic photoreceptor of the present invention having a configuration in which an electrical charge generating layer 35 comprised of an electrical charge generating substance and an electrical charge transporting layer 37 mainly comprised of an electrical charge transporting substance are formed on an electroconductive substrate 31.

In FIG. 3, a photosensitive layer 33 having an electrical charge generating substance and an adhesive resin as the main components is provided on the electroconductive substrate 31, and a protective layer 39 is further provided on the surface of the photosensitive layer. In this case, the outermost surface layer is the protective layer 39.

Figure 4:
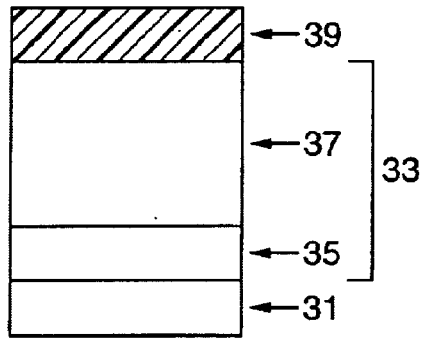

In FIG. 4, a configuration acquires an electrical charge generating layer 35 having an electrical charge generating substance as the main component and an electrical charge transporting layer 37 having an electrical charge transporting substance as the main component are formed on the electroconductive substrate 31, and the protective layer 39 is provided on the electrical charge transporting layer 37. In this case, the outermost surface layer is the protective layer 39.

Figure 5:
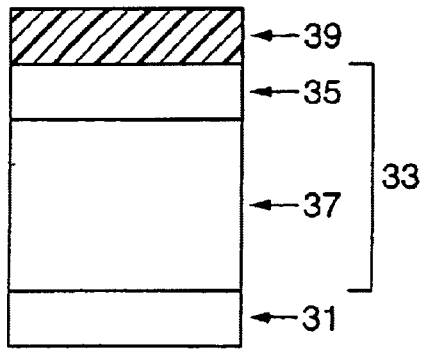

In FIG. 5, a configuration acquires an electrical charge transporting layer 37 having an electrical charge transporting substance as the main component and an electrical charge generating layer 35 having an electrical charge generating substance as the main component are formed on the electroconductive substrate 31, and the protective layer 39 is provided on the electrical charge generating layer 35. In this case, the outermost surface layer is the protective layer 39.

Substance used for the electroconductive substrate 31 may be anything having conductivity of a volume resistance of $10^{10}$ Ω·cm or less, and coated by a metal such as aluminum, nickel, chromium, nickel-chromium, copper, gold, silver, or platinum or the like, or a metal oxide such as tin oxide or indium oxide or the like, for example, by vapor deposition or sputtering, onto film-form or cylindrical plastic or paper, or using a sheet of aluminum, aluminum alloy, nickel, or stainless steel or the like, and making it into a crude tube by extrusion or drawing or the like, and then surface-treating the tube by cutting, super-finishing, or grinding or the like. The endless nickel belt and endless stainless belt disclosed in Japanese Patent Application Laid-Open No. S52-36016/1977 (published) may also be used for the electroconductive substrate 31.

Besides, an electroconductive powder dispersed in a suitable adhesive resin and coated onto the support material may also be used as the electroconductive substrate 31 of the present invention. Examples of powders for such electroconductive powder includes carbon black, acetylene black, metal powders such as aluminum, nickel, iron, nickel-chromium, copper, zinc, and silver, and metal oxide powders such as electroconductive tin oxide or ITO. For the adhesive resin used simultaneously, moreover, a thermoplastic resin, thermosetting resin, or photo hardening resin such as a polystyrene, styrene-acrylonitrile copolymer, styrene-butadiene copolymer, styrene-anhydrous maleic acid copolymer, polyester, vinyl polychloride, vinyl chloride-vinyl acetate copolymer, polyvinyl acetate, polyvinylidene chloride, polyarylate, phenoxy resin, polycarbonate, cellulose acetate resin, ethyl cellulose resin, polyvinyl butyral, polyvinyl formal, polyvinyl toluene, poly-N-vinyl carbazol, (meth)acrylic resin, silicone resin, epoxy resin, melamine resin, urethane resin, phenol resin, or alkyd resin. An electroconductive layer like this can be provided by dispersing these electroconductive powders and adhesive resins in a suitable solvent, such as tetrahydrofuran, dichloromethane, methylethyl ketone, or toluene, and coating it on.

Moreover, an electroconductive layer comprising a suitable cylindrical base material deposited by a heat-shrunk tube containing electroconductive powder such as a vinyl polychloride, polypropylene, polyester, polystyrene, vinylidene polychloride, polyethylene, rubber chloride, or Teflon (registered trademark) may be used to enhance the electroconductive substrate 31 of the present invention.

Next, the photosensitive layer is described. The photosensitive layer may be a single layer or formed layer, but, for the sake of description, the case in which the photosensitive layer is comprised by the electrical charge generating layer 35 and the electrical charge transporting layer 37 will be described first.

The electrical charge generating layer 35 is described first. The electrical charge generating layer 35 is a layer having an electrical charge generating substance for its main component. As necessary, an adhesive resin may also be used in conjunction therewith. For the electrical charge generating substance, inorganic materials and organic materials can be used.

For the inorganic material, crystalline selenium, amorphous selenium, selenium-tellurium, selenium-tellurium-halogen, or a selenium-arsenic compound, as well as amorphous silicon may be cited. Among amorphous silicones, those in which dangling bonds are terminated with a hydrogen atom or halogen atom, or those doped with boron atoms or phosphorous atoms or the like may be used to enhance the effect.

For the organic material, on the other hand, a commonly known material may be used. Such examples include phthalocyanine based pigments such as metallic phthalocyanine or non-metallic phthalocyanine, azulenium salt pigments, methyl squarate pigments, azo pigments having a carbazol skeleton, azo pigments having a triphenylamine skeleton, azo pigments having a diphenylamine skeleton, azo pigments having a dibenzothiophene skeleton, azo pigments having a fluorolenone skeleton, azo pigments having an oxadiazole skeleton, azo pigments having a bis-stilbene skeleton, azo pigments having a distyryloxadiazole skeleton, azo pigments having a distyrylcarbazole skeleton, perylene based pigments, anthraquinone based or polycyclic quinone based pigments, quinone-imine based pigments, diphenylmethane and triphenylmethane based pigments, benzoquinone and naphthoquinone based pigments, cyanine and azomethine based pigments, indigoid based pigments, and bisbenzimidazol based pigments. These electrical charge generating substances may be used alone or as mixtures of two or more types.

For the adhesive resin (binder resin) used as necessary in the electrical charge generating layer 35, examples include polyamides, polyurethanes, epoxy resins, polyketones, polycarbonates, silicone resins, acrylic resins, polyvinyl buterols, polyvinyl formals, polyvinyl ketones, polystyrenes, poly-N-vinyl carbazoles, and polyallylamides. These adhesive resins may be used alone or as mixtures of two or more types. For the adhesive resin in the electrical charge generating layer, moreover, in addition to the adhesive resins mentioned above, polymer electrical charge transporting substances (such as cited in Japanese Patent Application Laid-Open No. S64-1728/1989 (published), Japanese Patent Application Laid-Open No. S64-13061/1989 (published), Japanese Patent Application Laid-Open No. S64-19049/1989 (published), Japanese Patent Application Laid-Open No. H4-11627/1992 (published), Japanese Patent Application Laid-Open No. H4-225014/1992 (published), Japanese Patent Application Laid-Open No. H4-230767/1992 (published), Japanese Patent Application Laid-Open No. H4-320420/1992 (published), Japanese Patent Application Laid-Open No. 5-232727/1993 (published), Japanese Patent Application Laid-Open No. H6-234838/1994 (published), Japanese Patent Application Laid-Open No. H6-234839/1994 (published), Japanese Patent Application Laid-Open No. H6-295077/1994 (published), Japanese Patent Application Laid-open No. H7-56374/1995 (published), Japanese Patent Application Laid-Open No. H7-325409/1995 (published), Japanese Patent Application Laid-Open No. H9-80772/1997 (published), Japanese Patent Application Laid-open No. H9-80783/1997 (published), Japanese Patent Application Laid-Open No. H9-80784/1997 (published), Japanese Patent Application Laid-open No. H9-127713/1997 (published), Japanese Patent Application Laid-open No. H9-211877/1997 (published), Japanese Patent Application Laid-Open No. H9-222740/1997 (published), Japanese Patent Application Laid-Open No. H9-265197/1997 (published), Japanese Patent Application Laid-Open No. H9-265201/1997 (published), Japanese Patent Application Laid-Open No. H9-297419/1997 (published), and Japanese Patent Application Laid-Open No. H9-304956/1997 (published), for example) can be used. The amount of adhesive resin used in the electrical charge generating layer 35 should be 0 to 500 parts by weight, and preferably 0 to 200 parts by weight, to 100 parts by weight of the electrical charge generating substance. As necessary, moreover, a low molecular-weight electrical charge transporting substance may be added.

Among the low molecular-weight electrical charge transporting substances which may concurrently be used in the electrical charge generating layer 35 are positive hole transporting substances and electron transporting substances.

As electron transporting substances, such electron accepting substances as chloranile, bromanile, tetracyanoethylene, tetracyanoquinodimethane, 2,4,7-trinitro-9-fluorolenone, 2,4,5,7-tetranitro-9-fluorolenone, 2,4,5,7-tetranitroxanthone, 2,4,8-trinitrothioxanthone, 2,6,8-trinitro-4H-indeno [1,2-b] thiophene-4-one, 1,3,7-trinitrodibenzothiophene -5,5-dioxide, and diphenoquinone derivatives may be cited. These electron transporting substances may be used alone or in mixtures of two or more types.

For the positive hole transporting substance, the electron donor substances mentioned below may be used for enhanced effect. Positive hole transporting substances that may be cited include oxazole derivatives, oxadiazole derivatives, imadazole derivatives, monoalylamine derivatives, dialylamine derivatives, trialylamine derivatives, stilbene derivatives, α-phenylstilbene derivatives, benzidine derivatives, dialylmethane derivatives, trialylmethane derivatives, 9-styrylanthracene derivatives, pyrazoline derivatives, divinylbenzine derivatives, hydrazone derivatives, indene derivatives, butadiene derivatives, pyrene derivatives, bisstilbene derivatives, and enamine derivatives, but there are other known materials as well. These positive hole transporting substances can be used alone or in mixtures of two or more types. The amount of low molecular-weight electrical charge transporting substance used in the electrical charge generating layer 35 should be 0 to 500 parts by weight, and preferably 0 to 300 parts by weight, to 100 parts by weight of the electrical charge generating substance.

As methods for forming the electrical charge generating layer 35, vacuum film forming methods and the method of casting from a solution dispersion system may be cited.

For former methods, such processes as vacuum vapor deposition, glow-discharge decomposition, ion plating, sputtering, reactive sputtering, and CVD, wherewith the inorganic materials and organic materials mentioned earlier may be formed as well.

In order to form an electrical charge generating layer using the casting method, as will be described herewith, is carried out by dispersing the inorganic or organic electrical charge generating substances mentioned earlier with a solvent such as tetrahydrofuran, dioxane, dioxolane, toluene, dichloromethane, monochlorobenzene, dichloroethane, cyclohexanone, cyclopentanone, anisole, xylene, methylethyl ketone, acetone, ethyl acetate, or butyl acetate or the like, if necessary with a binder resin, using a ball mill, attrition mill, sand mill, or bead mill or the like, coating on the dispersion liquid after suitable dilution. As necessary, moreover, a leveling agent such as dimethyl silicone oil or methylphenyl silicone oil or the like can be added. The coating may be done using an immersion coating process or a spray coating, bead coating, or ring coating process or the like.

The film thickness of the electrical charge generating layer formed as described above will be suitable at between 0.01 and 5 $\mu$m or so, but a range of 0.05 to 2 $\mu$m is preferable.

The electrical charge transporting layer 37 is formed by dissolving or dispersing the electric charge transporting substance in an appropriate solvent, coating that onto the electrical charge generating layer 35, and drying it.

For the electrical charge transporting substance, use can be made of the electrical charge transporting substances mentioned in electrical charge generating layer 35, or positive hole transporting substances and electrical charge transporting polymers.

For the adhesive resin, thermoplastic or thermosetting resins such as polystyrenes, styrene-acrylonitrile copolymers, styrene-butadiene copolymers, styrene-maleic anhydride copolymers, polyesters, polyvinyl chlorides, vinyl chloride-vinyl acetate copolymers, polyvinyl acetates, polyvinylidene chlorides, polyacrylate resins, phenoxy resins, polycarbonates, cellulose acetate resins, ethyl cellulose resins, polyvinyl butyrals, polyvinyl formals, polyvinyl toluenes, poly-N-vinyl carbazols, acrylic resins, silicone resins, epoxy resins, melamine resins, urethane resins, phenol resins, and alkyd resins and the like may be cited.

The amount of the electrical charge transporting substance suitably be 20 to 300 parts by weight, but preferably 40 to 150 parts by weight, to 100 parts by weight of the adhesive resin. When an electrical charge transporting polymer is used, it is possible to use such alone or together with an adhesive resin.

For the solvent used in the coating method for the electrical charge transporting layer 37, the same ones as those used for the electrical charge generating layer mentioned earlier may be used, but the solvent should be the one which dissolves the electrical charge transporting substance and the adhesive resin well. Such solvents may be used alone or in mixtures of two or more types. In forming the electrical charge transporting layer 37, furthermore, the same coating method used for the electrical charge generating layer 35 may be used.

As necessary, moreover, a plasticizer and/or leveling agent can be added.

For plasticizers which may be used with the electrical charge transporting layer 37 includes dibutylphthalate or dioctylphthalate which are used as plasticizers for ordinary resins may be used with a suitable amount of 0 to 30 parts by weight or so to 100 parts by weight of the adhesive resin.

For leveling agents which may be used together with the electrical charge transporting layer 37, silicone oils such as dimethyl silicone oil or methylphenyl silicone oil, or oligomers or polymers having a perfluoroalkyl group in a side chain, can be used, with a suitable amount for use ranges from 0 to 1 parts by weight or so to 100 parts by weight of the adhesive resin.

The film thickness of the electrical charge transporting layer 37 suitably be 5 to 50 $\mu$m or so, with a range of 10 to 40 $\mu$m or so is suitable under electrical characteristics considered for resolution, texture smudging, charging potential and sensitivity.

When the electrical charge transporting layer 37 is to be the surface layer of the photoreceptor, moreover, an inorganic filler is added for the purpose of enhancing the wear resistance of the entire layer or of the surface portion of the electrical charge transporting layer 37.

For the inorganic filler used here, powders of such metals as copper, tin, aluminum, or indium, metal oxides such as silica, tin oxide, zinc oxide, titanium oxide, alumina, zirconium oxide, indium oxide, antimony oxide, bismuth oxide, calcium oxide, tin oxide doped with antimony, or indium oxide doped with tin, metal fluorides such as tin fluoride, calcium fluoride, or aluminum fluoride, and such inorganic materials as potassium titanate or boron nitride may be cited. As necessary, two or more types of these inorganic fillers may be mixed and used together.

It is also possible to subject these inorganic fillers to a surface treatment for the purpose of enhancing the dispersibility thereof. For the surface treatment agent used for that purpose, titanate based coupling agents, aluminum based coupling agents, zircoaluminate based coupling agents, higher aliphatic acids, silane coupling agents, $Al_2O_3$, $TiO_2$, $ZrO_2$, silicone, aluminum stearate, or mixtures thereof, and the like, may be used.

The average primary particle size of these inorganic fillers used in the outermost surface layer should be within a range of 0.01 to 0.8 $\mu$m.

The ratio of inorganic filler contained in the outermost surface layer will vary depending on various factors, such as the targeted wear resistance, inorganic filler particle size, material, and image forming process used. Nevertheless, 0.5 to 40 wt. % relative to the total quantity of the outermost surface layer portion in which the inorganic filler is dispersed will be good, with 2 to 30 being preferable.

The surface portion containing these inorganic fillers is formed by first dispersing the inorganic filler or fillers together with an organic solvent using a conventional method such as a ball mill, attrition mill, sand mill, bead mill, or ultrasound, then a binder resin and aliphatic polyester are added, or, alternatively, a copolymer polyarylate resin having an alkylene-aryldicarboxylate structural unit is added as the binder resin, and that is coated on. At this time, moreover, as necessary, such additives as dispersants like polycarboxylic acid compounds, electrical charge transporting substances, leveling agents, or plasticizers are used. These binder resins, aliphatic polyesters, and additives may be added prior to, during, or after the inorganic filler dispersing process. The organic solvent used in this dispersion liquid will vary depending on the dispersibility of the inorganic filler and the coating method used, but in general those which were mentioned for the electrical charge generating layer 35 can be used, and two or more solvents can be mixed together. For the binder resin used in the outermost surface layer in which the inorganic filler is dispersed, the adhesive resins cited for the electrical charge transporting layer 37 and electrical charge generating layer 35 are used.

The binder resin amount will be different according to the layer structure in which the filler is contained.

As necessary, a dispersant is added for the purpose of enhancing the dispersibility of the inorganic filler and increasing the stability of the coating liquid. Polycarboxylic acid compounds are effective as such dispersants because they disperse the inorganic filler to a value close to the primary particle size and have no adverse effect on electrical characteristics or image characteristics.

For such polycarboxylic acid compounds, polymer compounds, oligomers, and low molecular-weight compounds having a plurality of residual carboxylic acid groups may be cited, with specific examples thereof being organic aliphatic acids and highly oxidized resins and the like. Examples of such polycarboxylic acid compounds that are oligomers or polymer compounds that may be cited include polyester resins, acrylic resins, copolymers wherein acrylic acid and methacrylic acid are used, styrene-(method)acrylic acid copolymers, and styrene-maleic anhydride copolymers. Such polycarboxylic acid compounds having an acid value of 10 to 400 (mgKOH/g) can be used effectively here (acid value being defined as the number of milligrams of potassium hydroxide required to neutralize the free aliphatic acid contained in 1 g thereof). The amount of such polycarboxylic acid compound added should be 0.01 to 50 parts by weight, and preferably 0.1 to 20 parts by weight, to 100 parts by weight of the inorganic filler contained.

Also, for the electrical charge transporting substances used in the outermost surface layer wherein the inorganic filler is dispersed, those cited for the electrical charge generating layer 35 can be used, while for the leveling agents and plasticizers, those cited for the electrical charge transporting layer 37 can be used, with suitable amounts of use thereof being the same as for the electrical charge transporting layer 37.

For the method of forming the surface layer wherein this inorganic filler is dispersed, the same coating methods can be used as those used for the electrical charge generating layer 35.

The film thickness of the surface portion wherein this inorganic filler is dispersed, moreover, can be the entire layer of the electrical charge transporting layer 37, but a thickness of 20 $\mu$m or less is desirable, and of 1 to 10 $\mu$m is especially desirable, in the interest of image characteristics and electrical characteristics.

The case in which the photosensitive layer has a single-layer structure is described next. With the single-layer structure, a photosensitive layer 33 wherein at least an electrical charge generating substance is dispersed in an adhesive resin is provided on an electroconductive substrate. The photosensitive layer 33 can be formed by dissolving or dispersing an electrical charge transporting substance other than the electrical charge generating substance and adhesive resin, as necessary, in an appropriate solvent, coating that on, and drying it. A plasticizer or leveling agent or the like can also be added as necessary. The electrical charge generating substances, electrical charge transporting substances, plasticizers, and leveling agents used can be those used for the electrical charge generating layer 35 and the electrical charge transporting layer 37.

For the adhesive resin, besides the adhesive resins cited earlier for the electrical charge transporting layer 37, the adhesive resins cited for the electrical charge generating layer 35 may also be used. The polymer electrical charge transport substances cited earlier can also be used for enhanced effect. The amount of the electrical charge generating substance used should be 1 to 40 parts by weight to 100 parts by weight of the resin component, while the amount of electrical charge transporting substance used should be 0 to 190 parts by weight and preferable 50 to 150 parts by weight. The photosensitive layer can be formed by using an immersion coating process or spray coating, bead coating, or ring coating or the like to coat on a coating liquid wherein the electrical charge generating substance and adhesive resin, together, when necessary, with an electrical charge transporting substance, have been dispersed with a dispersion machine or the like using a solvent such as tetrahydrofuran, dioxane, dichloroethane, or cyclohexane. The film thickness of the photosensitive layer suitably should be 5 to 25 $\mu$m or so.

When the photosensitive layer 33 having the single-layer structure is to be the surface layer of the photoreceptor, an inorganic filler is added for the purpose of enhancing the wear resistance of the entire layer or of the surface portion thereof. However, at this time, by causing a resin binder and aliphatic polyester to be contained with the inorganic filler, or by using a copolymer polyarylate resin having an alkylene-aryldicarboxylate structure, good images exhibiting no image smearing can be continuously obtained. For the inorganic fillers and resin binders dispersed in the surface portion in this single-layer structure, those cited for the electrical charge transporting layer 37 described earlier are used, and, as necessary, such polycarboxylic acid compounds, plasticizers, and leveling agents as those cited for the electrical charge transporting layer 37 are added. The amounts of these materials added, the method of fabricating the inorganic filler dispersion layer, and the film thickness, moreover, can be those cited for the electrical charge transporting layer 37 as described earlier.

In the photoreceptor of the present invention, a protective layer 39 is sometimes provided on the surface side of the photosensitive layer 33 for the purpose of protecting the photosensitive layer. An inorganic filler is dispersed in the protective layer 39 because high wear resistance is required in the layer on the outermost surface side of the photoreceptor, but good images with no image smearing can continuously be obtained by causing a resin binder and aliphatic polyester to be contained with the inorganic filler at this time, or by using a copolymer polyarylate resin having an alkylene-aryldicarboxylate structure. For the binder resin used in this protective layer, it is possible to jointly use a resin such as an ABS resin, ACS resin, olefin-vinyl monomer copolymer, polyester chloride, allyl resin, phenol resin, polyacetal, polyamide, polyamideimide, polyacrylate, polyallyl sulfone, polybutylene, polybutylene terephthalate, polycarbonate, polyether sulfone, polyethylene, polyethylene terephthalate, polyimide, acrylic resin, polymethyl pentene, polypropylene, polyphenylene oxide, polysulfone, polystyrene, polyarylate, AS resin, butadiene-styrene copolymer, polyurethane, polyvinyl chloride, polyvinylidene chloride, or epoxy resin.

For the inorganic filler dispersed in this protective layer 39, it is possible to use those mentioned earlier, and, as necessary, the polycarboxylic acid compounds, plasticizers, and/or leveling agents cited for the electrical charge transporting layer 37 are added. As to the amounts of these materials to add, the method of dispersing the inorganic filler, and the method of fabricating the protective layer 39, those cited for the electrical charge transporting layer 37 can be used. The thickness of the protective layer 39 suitably be 0.5 to 5 $\mu$m or so.

In the photoreceptor of the present invention, it is also possible to provide an intermediate layer between the protective layer 39 and either the photosensitive layer 33 or the electrical charge transporting layer 37. Binder resins are generally used as the main components in the intermediate layer. For these resins, polyamides, alcohol soluble nylons, water soluble polyvinyl butyrals, polyvinyl butyrals, and polyvinyl alcohols and the like may be cited. For the method of forming the intermediate layer, a generally used coating process such as described earlier is used. The thickness of the intermediate layer suitably be 0.05 to 2 $\mu$m or so.

In the photoreceptor of the present invention, an undercoat layer may be provided between the electroconductive substrate 31 and the photosensitive layer. The undercoat layer will generally be comprised mainly of resins, but, in view of the fact that the photosensitive layer will be coated thereon with a solvent, these resins should exhibit high solvent resistance to ordinary organic solvents. Such resins that may be cited include such water soluble resins as polyvinyl alcohols, casein, and sodium polyacrylate, such alcohol soluble resins as copolymer nylons and methoxymethylized nylon, and such hardening resins which form a three-dimensional network structure as polyurethanes, melamine resins, phenol resins, alkyd-melamine resins, and epoxy resins. To the undercoat layer, furthermore, in the interest of preventing moire and reducing the residual electric potential and so forth, finely pulverized pigments may be added of metal oxides which can be exemplified by titanium oxide, silica, alumina, zirconium oxide, tin oxide, and indium oxide and the like.

These undercoat layers can be formed using suitable solvents and coating methods, as for the photosensitive layer described earlier. For the undercoat layer in the present invention, furthermore, a silane coupling agent, titanium coupling agent, or chromium coupling agent or the like can be used. Moreover, in the undercoat layer of the present invention, effective use may be performed of those earlier mentioned having $Al_2O_3$ provided by anodization, organic substances such as polyparaxylylene (parylene), or inorganic substances such as $SiO_2$, $SnO_2$, $TiO_2$, ITO, or $CeO_2$ provided by a vacuum thin film formation process. Other commonly known substances can also be used. The film thickness of the undercoat layer suitably be 0 to 5 $\mu$m.

In the present invention, moreover, in order to improve environmental resistance, and in particular for keeping the sensitivity from declining and the residual electrical potential from rising, an antioxidant can be added to any of the layers such as the electrical charge generating layer, electrical charge transporting layer, undercoat layer, protective layer, or intermediate layer. As antioxidants which can be used in the present invention, the following may be cited.

Phenol based compounds: 2,6-di-t-butyl-p-cresol, butylated hydroxyanisole, 2,6-di-t-butyl-4-ethyl phenol, stearyl-β-(3,5-di-t-butyl-4-hydroxyphenyl) propionate, 2,2'-methylene-bis-(4-methyl-6-t-butyl phenol), 2,2'-methylene-bis-(4-ethyl-6-t-butyl phenol), 4,4'-thiobis-(3-methyl-6-t-butyl phenol), 4,4'-butylidene bis(3-methyl-6-t-butyl phenol), 1,1,3-tris-(2-methyl-4-hydroxy-5-t-butylphenyl) butane, 1,3,5-trimethyl-2,4,6-tris(3,5-di-t-butyl-4-hydroxybenzyl) benzene, tetrakis-[methylene-3-(3', 5'-di-t-butyl-4'-hydroxyphenyl) propionate] methane, bis[3,3'-bis (4'-hydroxy-3'-t-butylphenyl) butric acid] glycol ester, and tocopherols and the like.

Paraphenylene diamines: N-phenyl-N'-isopropyl-p-phenylene diamine, N,N'-di-sec-butyl-p-phenylene diamine, N,N'-di-sec-butyl-p-phenylene diamine, N-phenyl-N-sec-butyl-p-phenylene diamine, N,N'-di-isopropyl-p-phenylene diamine, N,N'-dimethyl-N,N'-di-t-butyl-p-phenylene diamine, and the like.

Hydroxyquinones: 2,5,-di-t-octylhydroquinone, 2,6,-didodecylhydroquinone, 2-dodecylhydroxyquinone, 2-dodecyl-5-chlorohydroxyquinone, 2-t-octyl-5-methylhydroxyquinone, 2-(2-octadecinyl)-5-methylhydroxyquinone, and the like.

Organic sulfide compounds: dilauryl -3,3'-thiodipropionate, ditetradecyl-3,3'-thiodipropionate, and the like.

Organic phosphide compounds: triphenyl phosphine, tri (nonylphenyl) phosphine, tri(dinonylphenyl) phosphine, tricresyl phosphine, tri(2,4-dibutylphenoxy) phospine, and the like.

These compounds are known as antioxidants for rubbers, plastics, and oils and the like, and are readily available commercially. The amount of antioxidant to be added in the present invention is 0.01 to 10 wt. % relative to the total weight of the layer to which added.

The image forming method and image forming apparatus of the present invention are described next with reference to the drawings.

<Image Recording Method, Image Forming Apparatus, and Image Recording Method Processing Unit>

By the image recording method and image forming apparatus of the present invention are meant an image recording method and image forming apparatus comprising at least a processes of charging, image exposure, and developing on a photoreceptor, using a photoreceptor containing inorganic filler and binder resin in the outermost surface layer of the present invention, and, after passing through these processes, comes transferring and fixing the toner image to an image bearing member (transfer paper), and cleaning the surface of the photoreceptor. Depending on the case, with an image forming method in which the latent electrostatic image is transferred directly to the transfer material, the processes mentioned above and used in conjunction with the photoreceptor need not necessarily be employed.

Figure 6:
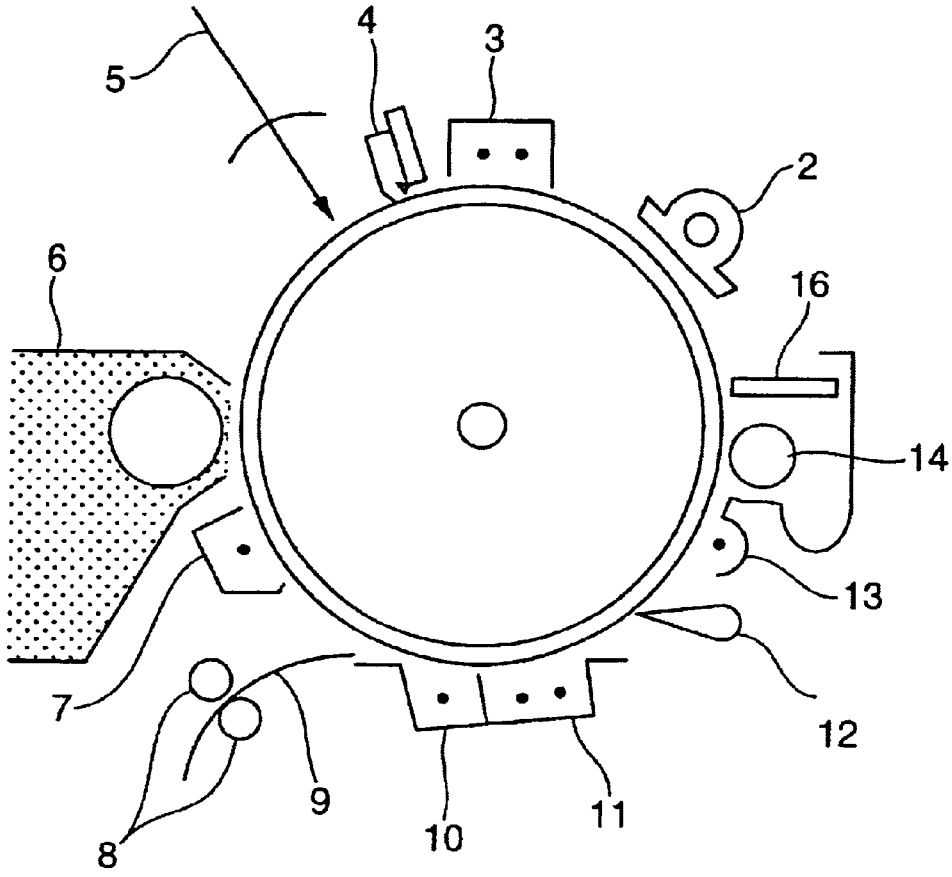
FIG. 6 is a cross-sectional view representing one example of the electrophotographic photoreceptor of the present invention having a configuration in which a photosensitive layer 33 mainly comprised of an electrical charge generating substance and an adhesive resin is formed on an electroconductive substrate 31, and a protective layer 39 is formed on the surface of the photosensitive layer.

FIG. 6 is a schematic view of one example of an image forming apparatus. FIG. 6 is referred to in describing the image recording method and image forming apparatus of the present invention. A charger 3 is used as the means for charging the photoreceptor 1 equally throughout the surface thereof. For these charger, a corotron device, scorotron device, solid discharge element, needle electrode device, roller charging device, electroconductive brush device or the like is used, with all known schemes also usable.

Next, an image exposure unit 5 is used for forming the latent electrostatic image on the evenly charged photoreceptor. For the light source thereof, any light emitting device such as a fluorescent lamp, tungsten lamp, halogen lamp, mercury lamp, sodium lamp, light emitting diode (LED), semiconductor laser (LD), or a common light emitting substance such as electro-luminescence (EL) can be used. In order to effect irradiation with only light of a desired wavelength, any of various filters such as a sharp cutting filter, band pass filter, near infrared cutting filter, dichroic filter, interference filter, or light-temperature conversion filter may be used.

Next, a developing unit 6 is used for making the latent electrostatic image visible on the photoreceptor. Developing schemes available include 1) single-component developing processes and two-component developing processes in which a dry toner is used, and 2) dry developing processes in which a wet toner is used. When a positive (negative) charge is charged on the photoreceptor and image exposure is performed, a positive (negative) latent electrostatic image is formed on the photoreceptor surface. If this is developed with toner of negative (positive) polarity, a positive image is obtained, whereas if it is developed with a toner of positive (negative) polarity, a negative image is obtained.

Next, a transfer charger 10 is used for transferring the toner image made visible on the photoreceptor to the transfer material. A pre-transfer charger 7 may also be used to better enhance the transfer. For these transfer means, it is possible to use a transfer charger, a photo static transfer scheme using a bias roller, an adhesive transfer method, a mechanical transfer scheme such as a pressure transfer method or the like, or a magnetic transfer scheme. As an electrostatic transfer scheme, the charger mentioned earlier can be used.

Next, a separation charger 11 and separation pawl 12 are used as means for separating the transfer material 9 from the photoreceptor. As other separation means, electrostatic adhesion induction separation, side edge belt separation, end grip conveyance, and curvature separation and the like are used. For the separation charger, the charger mentioned earlier can be used.

Next, a fur brush 14 and cleaning blade 15 are used for cleaning away the toner remained on the photoreceptor after the transfer. A pre-cleaning charger 13 may also be used to perform the cleaning more efficiently. There are other cleaning means such as web schemes and magnetic brush schemes and the like, which may be used alone, respectively, or a plurality of such schemes may be combined for use.

Next, if necessary, decharger are used for removing the latent image on the photoreceptor. For the decharger, a decharging lamp 2 or decharger is used, for which the exposure light sources and charger mentioned earlier can be used, respectively. In addition, all known processes for such operations as reading originals not proximate to the photoreceptor, feeding paper, fixing, and rejecting paper and the like can be used. The present invention comprises an image forming method and image forming apparatus which uses the electrophotographic photoreceptor relating to the present invention in such image forming means.

These image forming means may be incorporated inside a copier, fax machine, or printer in a fixed manner, or incorporated in those apparatuses in the form of a processing unit which can be loaded and unloaded freely. By image forming apparatus processing unit is meant as detachable apparatus (component) having a built-in photoreceptor and at least one other kind of means for instance, charger, image developer, transfer means, cleaning means, or decharger. The present invention provides an image forming apparatus processing unit that has at least one kind of means, namely charging, developing, transferring, cleaning, or decharging, integrated together with a photoreceptor containing inorganic filler, a binder resin or a copolymer polyarylate resin having an alkylene-aryldicarboxylate structure, and an aliphatic polyester in the outermost surface layer thereof.

Figure 7:
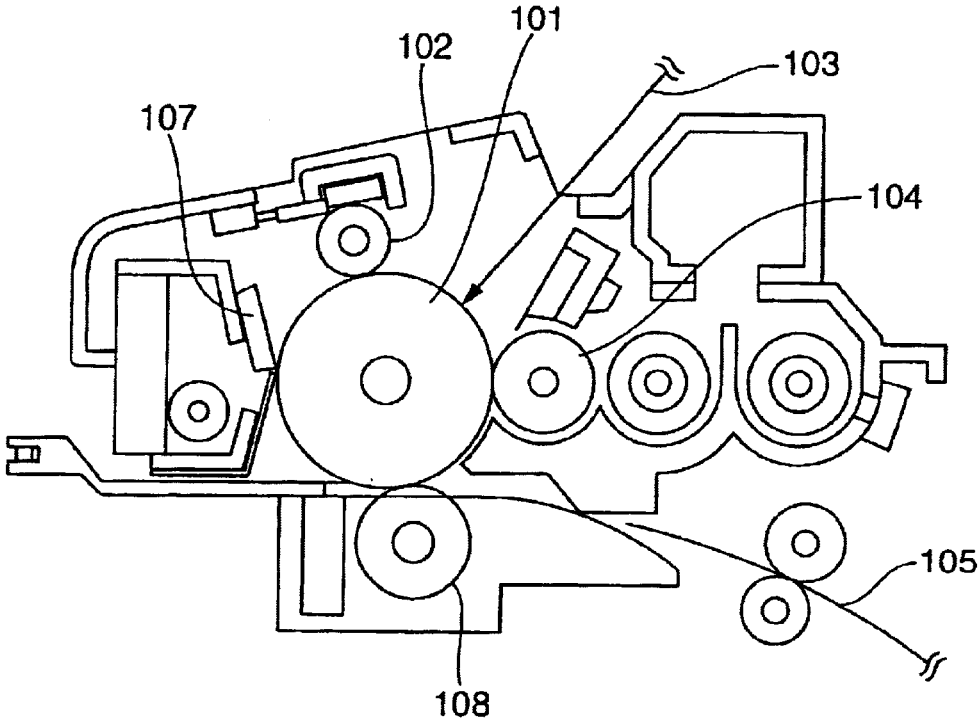
FIG. 7 is a cross-sectional view representing one example of the electrophotographic photoreceptor of the present invention having a configuration in which an electrical charge generating layer 35 mainly comprised of an electrical charge generating substance and an electrical charge transporting layer 37 mainly comprised of an electrical charge transporting substance are formed on an electroconductive substrate 31, and a protective layer 39 is formed on the electrical charge transporting layer 37.

FIG. 7 is a schematic view of one example of an image forming apparatus processing unit.

In FIG. 7, 101 indicates a photosensitive drum, 102 a charging device, 103 exposure light, 104 a developer device, 105 a transfer material, 106 a transfer device, and 107 a cleaning blade.

The present invention is next described in even greater detail by embodiments, but the present invention is not limited to or by the embodiments mentioned below. The parts used in the embodiments all refer to parts by weight. First will be described an embodiment of an electrophotographic photoreceptor in which the outermost surface layer thereof contains at least an inorganic filler, binder resin or a copolymer polyarylate resin having an alkylene-aryldicarboxylate structure, and aliphatic polyester.

EMBODIMENT A-1

To an aluminum drum having a diameter ϕ of 30 mm, the undercoat layer coating liquid, electrical charge generating layer coating liquid, and electrical charge transporting layer coating liquid having the compositions mentioned below were successively coated on and dried, thereby forming a 3.5 μm undercoat layer, 0.2 μm electrical charge generating layer, and 22 μm electrical charge transporting layer. The coating liquid for the layer containing inorganic filler in the outermost surface layer was prepared by ball mill dispersing the inorganic filler and solvent mentioned below for 24 hours using alumina balls, and adding a binder resin, aliphatic polyester, electrical charge transporting substance, and solvent to that dispersion liquid. This liquid was spray coated onto the electrical charge transporting layer and dried, and an outermost surface layer containing inorganic filler was accordingly provided to a thickness of 4 μm, thereby the electrophotographic photoreceptor of the present invention was obtained.

Undercoat Layer Coating Liquid

| (Undercoat layer coating liquid) | |
|---|---|
| Alkyd resin (Beccozol 1307-60-EL, made by Dainippon Ink and Chemicals, Inc.) | 6 parts |
| Melamine resin (Super Bekkamine G-821-60, made by Dainippon Ink and Chemicals, Inc.) | 4 parts |
| Titanium oxide | 40 parts |
| Methylethyl ketone | 50 parts |

(Electrical charge generating layer coating liquid)

Bisazo pigment having structure below 2.5 parts

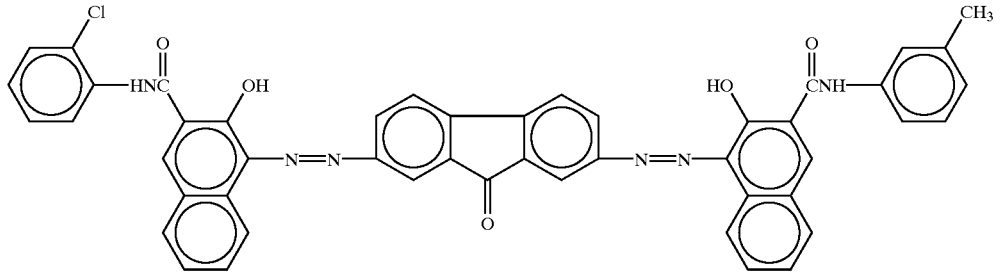

| | |
|---|---|
| Polyvinyl butyral (XYHL, made by UCC) | 0.5 parts |
| Cyclohexanone | 200 parts |
| Methylethyl ketone | 80 parts |

-continued

| | |
|---|---|
| (Electrical charge transporting layer coating liquid) | |
| Bisphenol Z polycarbonate (Panlite TS-2050, made by Teijin Chemicals, Ltd.) | 10 parts |
| Low molecular-weight electrical charge transporting substance (D-1) having structure below | 7 parts |

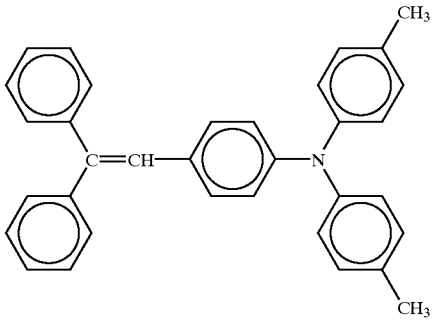

| | |
|---|---|
| Tetrahydrofuran | 100 parts |
| Tetrahydrofuran solution of 1% silicone oil (KF50-100CS, made by Shin-Etsu Chemical Co., Ltd.) | 1 part |
| (Inorganic filler containing layer coating liquid) | |
| Hydrophobic silica powder (KMP-X100, made by Shin-Etsu Chemical Co., Ltd.) | 1.5 parts |
| Binder resin | |
| Bisphenol Z polycarbonate (Panlite TS-2050, made by Teijin Chemicals, Ltd.) | 4 parts |
| Aliphatic polyester | |
| Polycaprolactone (TONE P767E, made by Union Carbide) | 0.5 part |
| Low molecular-weight electrical charge transporting substance (D-1 cited for electrical charge transporting layer) | 3 parts |
| Cyclohexanone | 60 parts |
| Tetrahydrofuran | 200 parts |
| Embodiment A-2 | |

Other than altering the inorganic filler of the inorganic filler containing layer coating liquid in Embodiment A-1 to 1.5 parts titanium oxide (CR97, made by Ishihara Sangyo Kaisha, Ltd.), and making the film thickness in the outermost surface layer containing the inorganic filler 2.5 $\mu$m, an electrophotographic photoreceptor was fabricated as in Embodiment A-1.

EMBODIMENT A-3

Other than altering the inorganic filler of the inorganic filler containing layer coating liquid in Embodiment A-1 to 1.5 parts $\alpha$-type alumina (AA03, made by Sumitomo Chemical Co., Ltd), adding 0.1 part polycarboxylic acid compound (BYK-P104, made by Bic Chemie) as the dispersant when effecting the ball mill dispersion, and making the aliphatic polyester of Embodiment A-1 to be 0.03 part, an electrophotographic photoreceptor was fabricated as in Embodiment A-1.

EMBODIMENT A-4

Other than changing the aliphatic polyester of the inorganic filler containing layer coating liquid of Embodiment A-3 to those mentioned below, an electrophotographic photoreceptor was fabricated as in Embodiment A-3.

| Aliphatic polyester | |
|---|---|
| Poly 3-hydroxy butylate (PHB) (Aldrich reagent) | 0.03 part |

EMBODIMENT A-5

Other than changing the aliphatic polyester of the inorganic filler containing layer coating liquid of Embodiment A-3 to those mentioned below, an electrophotographic photoreceptor was fabricated as in Embodiment A-3.

| Aliphatic polyester | |
|---|---|
| Polycondensate polyester of sebacic acid and alkylene glycol (P-202, made by Dainippon Ink and Chemical Co., Inc.) | 0.03 part |

EMBODIMENT A-6

Other than changing the aliphatic polyester of the inorganic filler containing layer coating liquid of Embodiment A-3 to those mentioned below, an electrophotographic photoreceptor was fabricated as in Embodiment A-3.

| Aliphatic polyester | |
|---|---|
| Polycondensate polyester of adipic acid and alkylene glycol (P-204N, made by Dainippon Ink and Chemical Co., Inc.) | 0.03 part |

EMBODIMENT A-7

Other than changing the aliphatic polyester of the inorganic filler containing layer coating liquid of Embodiment A-2 to those mentioned below, an electrophotographic photoreceptor was fabricated as in Embodiment A-2.

| Aliphatic polyester | |
|---|---|
| Polycondensate polyester of sebacic acid and alkylene glycol (P-202, made by Dainippon Ink and Chemical Co., Inc.) | 0.5 part |

COMPARATIVE EXAMPLE A-1

Other aliphatic polyester was not added in the inorganic filler containing layer coating liquid of Embodiment A-1, an electrophotographic photoreceptor was fabricated as in Embodiment A-1.

COMPARATIVE EXAMPLE A-2

Other aliphatic polyester was not added in the inorganic filler containing layer coating liquid of Embodiment A-2, an electrophotographic photoreceptor was fabricated as in Embodiment A-2.

COMPARATIVE EXAMPLE A-3

Other than aliphatic polyester was not added in the inorganic filler containing layer coating liquid of Embodiment A-3, an electrophotographic photoreceptor was fabricated as in Embodiment A-3.

COMPARATIVE EXAMPLE A-4

Other than that the inorganic filler containing outermost surface layer of Embodiment A-1 was not provided, an electrophotographic photoreceptor was fabricated as in Embodiment A-1.

The electrophotographic photoreceptors in Embodiments 1 to 7 and Comparative Examples 1 to 4 fabricated as described in the foregoing were subjected to continuous paper run tests using 50,000 sheets of A4 size paper. First, the photoreceptors were loaded in an electrophotographic apparatus processing unit, and the initial charging potential was set at −850 V in a modified imagio MF2200 made by Ricoh Co., Ltd., using a 655 nm semiconductor laser as the image exposure light source. After that, the continuous paper run tests were started, image evaluations were made initially and after each 10,000 sheets, and the amount of film thickness decrease was measured after making 50,000 copies. The results are given in Table 1.

Next, for newly fabricated electrophotographic photoreceptors in Embodiments 1 to 5 and Comparative Examples 1 to 5, image degradation tests were conducted by exposure to ozone gas to accelerate the tests simulating the oxidizing gases generated by electrification chargers and the like. First, initial images were taken as in the continuous paper run tests described above. Following by, allowing the photoreceptors to stand for 50 hours in a 5 ppm ozone gas atmosphere, after which they were taken out into the initial environment and 5 hours after that images were again taken. The results of evaluation of the images after exposure to one gas are given in Table 1.

TABLE 1

| | | Continuous paper run test results | | |
|---|---|---|---|---|
| | Initial image evaluation | Image evaluation after each 10,000 sheets | Amount of wear after 50,000-sheet test (ìm) | Image evaluation after exposure to ozone gas |
| Example A-1 | Good | Good up to 50,000 sheets | 2.3 | Good (unchanged from initial image) |
| Example A-2 | Good | Good up to 50,000 sheets | 2.8 | Good (unchanged from initial image) |
| Example A-3 | Good | Good up to 50,000 sheets | 1.3 | Good (unchanged from initial image) |
| Example A-4 | Good | Good up to 50,000 sheets | 1.3 | Good (unchanged from initial image) |
| Example A-5 | Good | Good up to 50,000 sheets | 1.3 | Slight thickening of fine lines observed |
| Example A-6 | Good | Good up to 50,000 sheets | 1.3 | Slight thickening of fine lines observed |
| Example A-7 | Good | Good up to 50,000 sheets | 1.3 | Slight thickening of fine lines observed |
| Comp.Ex. A-1 | Good | Image smearing occurred at 20,000 sheets and resolution deteriorated | 2.3 | Intense image smearing occurred |
| Comp.Ex. A-2 | Good | Image smearing occurred at 30,000 sheets and resolution deteriorated | 1.7 | Image smearing occurred |
| Comp.Ex. A-3 | Good | Image smearing occurred at 20,000 sheets and resolution deteriorated | 1.2 | Image smearing occurred |
| Comp.Ex. A-4 | Good | Texture smudging occurred at 30,000 sheets | 5.0 | Good (unchanged from initial image) |

It is seen from the continuous paper run test results given in Table 1 that good images were obtained with the photoreceptors in which an inorganic filler was dispersed in the outermost surface layer with the intention of enhancing wear resistance, that is, the photoreceptors of Embodiments 1 to 7 containing a aliphatic polyester, whereas image smearing occurred after repeated copying with the photoreceptors of Comparative Examples 1 to 3 containing no aliphatic polyester. It is also seen that the photoreceptors of Embodiments 1 to 7 of the present invention exhibit high wear resistance as compared to the photoreceptor of Comparative Example 4 in which no layer containing inorganic filler is provided in the outermost surface layer. It is seen from the results of image degradation tests involving exposure to ozone gas, moreover, that, as compared to the photoreceptors of the comparative examples containing no aliphatic polyester, the photoreceptors of the embodiments containing a aliphatic polyester exhibit resistance to oxidizing gases.

Accordingly it has been clearly demonstrated that, because of the photoreceptor of the present invention, in which the inorganic filler, binder resin, and aliphatic polyester are contained in the outermost surface layer thereof, a photoreceptor having high wear resistance, and both high durability and high image quality, with no occurrence of abnormal images due to image smearing or the like with repeated copying are provided. It has also been clearly demonstrated that an image forming process, image forming apparatus, and image forming apparatus processing unit in which the photoreceptor of the present invention is used exhibits high performance and high reliability.

Based on the present invention, because of the photoreceptor having in the outermost surface layer thereof at least an inorganic filler, binder resin, and aliphatic polyester, an electrophotographic photoreceptor is obtained that exhibits high wear resistance and also exhibits high image quality and high durability, with no abnormal images occurring due to image smearing or the like in repeated copying. By using the electrophotographic photoreceptor of the present invention, moreover, highly reliable high-performance image forming processes, image forming apparatuses, and image forming apparatus processing units can be provided.

Next, embodiments are described that relate to an electrophotographic photoreceptor in which the outermost surface layer thereof contains at least an inorganic filler and binder resin, and that binder resin is a copolymer polyarylate having an alkylene-arylcarboxylate structural unit. The "parts" mentioned in the embodiments all refer to parts by weight. In the structure of the copolymer polyarylate having an alkylene-arylcarboxylate structural unit used in the embodiments, moreover, it is clear that the GPC molecular weight distribution is a simple dispersion, that the differential scanning calorimetry (DSC) glass transition temperature is simple, and that this is a simple component polymer from the fact that the film coated on after dissolving is uniform with no visible island structures. The compositional ratio of this copolymer polyarylate having an alkylene-arylcarboxylate structural unit was calculated from therthermolysis-gas chromotographic mass analysis, H—NMR, and C13-NMR, and the glass transition temperature was found by differential scanning calorimetry (DSC).

<Embodiment B-1>

To an aluminum drum having a diameter ϕ of 30 mm, the undercoat layer coating liquid, electrical charge generating layer coating liquid, and electrical charge transporting layer coating liquid having the compositions mentioned below were successively coated on and dried, thereby forming a 3.5 μm undercoat layer, 0.2 μm electrical charge generating layer, and 22 μm electrical charge transporting layer. The coating liquid for the layer containing inorganic filler in the outermost surface layer was prepared by ball mill dispersing the inorganic filler and solvent mentioned below for 24 hours using alumina balls, and adding to that dispersion liquid a solution in which a binder resin and electrical charge transporting substance were dissolved. This liquid was spray coated onto the electrical charge transporting layer, and an outermost surface layer containing inorganic filler was accordingly provided to a thickness of 4 μm, thereby the electrophotographic photoreceptor of the present invention was obtained.

| | |
|---|---|
| (Undercoat layer coating liquid) | |
| Alkyd resin (Beccozol 1307-60-EL, made by Dainippon Ink and Chemicals, Inc.) | 6 parts |
| Melamine resin (Super Bekkamine G-821-60, made by Dainippon Ink and Chemicals, Inc.) | 4 parts |
| Titanium oxide | 40 parts |
| Methylethyl ketone | 50 parts |
| (Electrical charge generating layer coating liquid) | |
| Bisazo pigment having structural formula I below | 2.5 parts |
| Polyvinyl butyral (XYHL, made by UCC) | 0.5 parts |
| Cyclohexanone | 200 parts |
| Methylethyl ketone | 80 parts |
| (Electrical charge transporting layer coating liquid) | |
| Bisphenol Z polycarbonate (Panlite TS-2050, made by Teijin Chemicals, Ltd.) | 10 parts |
| Low molecular-weight electrical charge transporting substance (D-1) having structural formula II below | 7 parts |
| Tetrahydrofuran | 100 parts |
| Tetrahydrofuran solution of 1% silicone oil (KF50-100CS, made by Shin-Etsu Chemical Co., Ltd.) | 1 part |

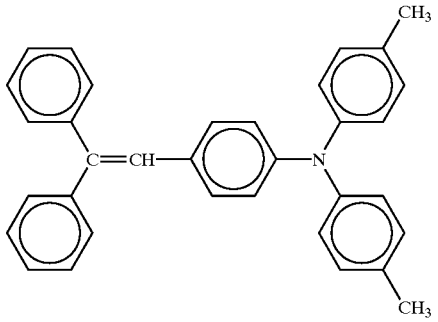

-continued

| (Inorganic filler containing layer coating liquid) | |
|---|---|
| Hydrophobic silica powder (KMP-X100, made by Shin-Etsu Chemical Co., Ltd.) | 1 part |
| Binder resin having structural formula III below (copolymer polyarylate having an alkylene-arylcarboxylate structural unit, U6000, made by Unitika, Ltd.) | 4 parts |
| Low molecular-weight electrical charge transporting substance | 3 parts |
| (low molecular-weight electrical charge transporting substance D-1 used in electrical charge transporting layer) | 3 parts |
| Cyclohexanone | 60 parts |
| Tetrahydrofuran | 200 parts |
| Glass transition temperature: 136° C. | |

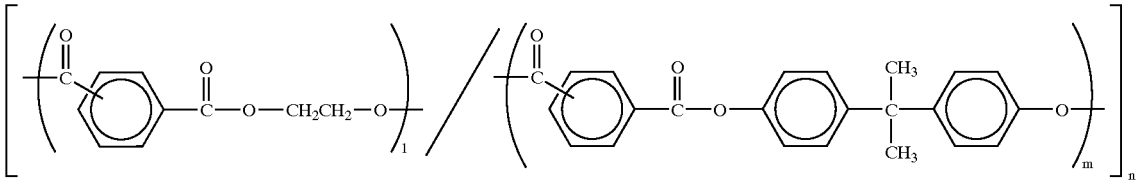

where l and m are mol ratios, with l=0.44, m=0.56; glass transition temperature: 136° C.; and polystyrene equivalent weight average molecular weight: 42,000

<Embodiment B-2>

Other than altering the inorganic filler of the inorganic filler containing layer coating liquid in Embodiment B-1 to 1 part titanium oxide (CR97, made by Ishihara Sangyo Kaisha, Ltd.), and making the film thickness in the outermost surface layer containing the inorganic filler to 2.5 $\mu$m, an electrophotographic photoreceptor was fabricated as in Embodiment B-1.

<Embodiment B-3>

Other than altering the inorganic filler of the inorganic filler containing layer coating liquid in Embodiment B-1 to 1.5 parts α-type alumina (AA03, made by Sumitomo Chemical Co., Ltd), and adding 0.04 part polycarboxylic acid compound (BYK-P104, made by Bic Chemie) as the dispersant when effecting the ball mill dispersion, an electrophotographic photoreceptor was fabricated as in Embodiment B-1.

<Embodiment B-4>

Other than changing the binder resin of the inorganic filler containing layer coating liquid of Embodiment B-3 to that having the structural formula IV shown below, an electrophotographic photoreceptor was fabricated as in Embodiment B-3.

| | |
|---|---|
| Binder resin (copolymer polyarylate having an alkylene-arylcarboxylate structural unit, U4015, made by Unitika, Ltd.) | 4 parts |

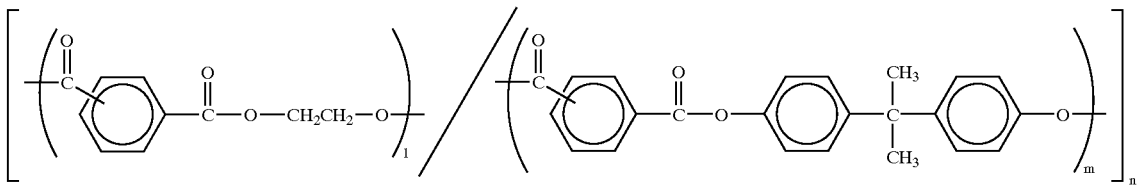

where l and m are mol ratios, with l=0.32, m=0.68; glass transition temperature: 149° C.; and polystyrene equivalent weight average molecular weight: 47,000

EMBODIMENT B-5

Other than changing the binder resin of the inorganic filler containing layer coating liquid of Embodiment B-3 to that having the structural formula V shown below, an electrophotographic photoreceptor was fabricated as in Embodiment B-3.

Binder resin 4 parts
(copolymer polyarylate having an alkylene-arylcarboxylate structural unit, U1060, made by Unitika, Ltd.)

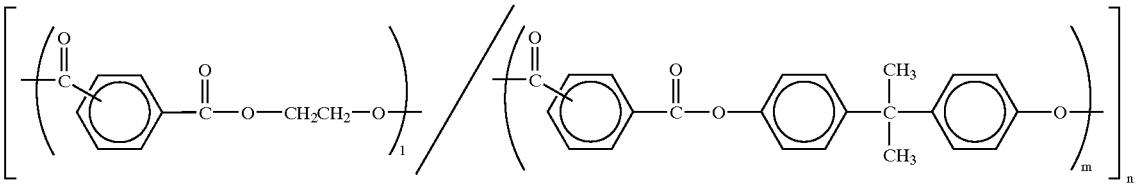

where l and m are mol ratios, with l=0.18, m=0.82; glass transition temperature: 180° C.; and polystyrene equivalent weight average molecular weight: 44,000

<Comparative Example B-1>

Other than changing the binder resin of the inorganic filler containing layer coating liquid of Embodiment B-1 to 4 parts bisphenol A polycarbonate (Panlite C1400, made by Teijin Chemicals, Ltd.), an electrophotographic photoreceptor was fabricated as in Embodiment B-1.

<Comparative Example B-2>

Other than changing the binder resin of the inorganic filler containing layer coating liquid of Embodiment B-2 to 4 parts bisphenol A polycarbonate (Panlite C1400, made by Teijin Chemicals, Ltd.), an electrophotographic photoreceptor was fabricated as in Embodiment B-2.

<Comparative Example B-3>

Other than changing the binder resin of the inorganic filler containing layer coating liquid of Embodiment B-2 to 4 parts bisphenol A polycarbonate (Panlite C1400, made by Teijin Chemicals, Ltd.), an electrophotographic photoreceptor was fabricated as in Embodiment B-2.

<Comparative Example B-4>

Other than changing the binder resin of the inorganic filler containing layer coating liquid of Embodiment B-3 to the polyarylate having the structural formula VI below, an electrophotographic photoreceptor was fabricated as in Embodiment B-3.

Binder resin 4 parts
(polyarylate: U100, made by Unitika, Ltd.)

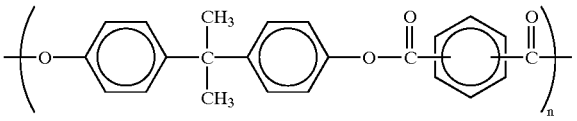

Glass transition temperature: 191° C.

<Comparative Example B-5>

Other than inorganic filler containing outermost surface layer of Embodiment B-1 was not provided, an electrophotographic photoreceptor was fabricated as in Embodiment B-1.

The electrophotographic photoreceptors in Embodiments 1 to 5 and Comparative Examples 1 to 5 fabricated as described in the foregoing were subjected to continuous paper run tests using 50,000 sheets of A4 size paper. First, the photoreceptors were loaded in an electrophotographic apparatus processing unit, and the initial charging potential was set at −850 V in a modified imagio MF2200 made by Ricoh Co., Ltd., using a 655 nm semiconductor laser as the image exposure light source. After that, the continuous paper run tests were started, image evaluations were made initially and after each 10,000 sheets, and the amount of film thickness decrease was measured after making 50,000 copies. The results are given in Table 2.

Next, for newly fabricated electrophotographic photoreceptors in Embodiments 1 to 5 and Comparative Examples 1 to 5, image degradation tests were conducted by exposure to ozone gas to accelerate tests simulating the oxidizing gases generated by chargers and the like. First, initial images were taken as in the continuous paper run tests described above. Thereafter, these photoreceptors were allowed to stand for 50 hours in a 5 ppm ozone gas atmosphere, after which they were taken out into the initial environment and 5 hours after, images were again taken. The results of evaluation of the images after exposure to ozone gas are given in Table 2 below.

TABLE 2

| | | Result of continuous paper run test | | |
|---|---|---|---|---|
| | Initial image evaluation | Image evaluation after each 10,000 sheets | Amount of wear after 50,000-sheet test (μm) | Image evaluation after exposure to ozone gas |
| Example B-1 | Good | Good up to 50,000 sheets | 2.8 | Slight thickening of the lines observed |
| Example B-2 | Good | Good up to 50,000 sheets | 2.3 | Good Good (unchanged from initial image) |
| Example B-3 | Good | Good up to 50,000 sheets | 1.4 | Good (unchanged from initial image) |
| Example B-4 | Good | Good up to 50,000 sheets | 1.5 | Good (unchanged from initial image) |
| Example B-5 | Good | Slight thickening of fine lines observed at 50,000 sheets | 1.4 | Slight thickening of the lines observed |
| Comp.Ex. B-1 | Good | Image smearing occurred at 20,000 sheets and resolution deteriorated | 2.6 | Intense image smearing occurred |
| Comp.Ex. B-2 | Good | Image smearing occurred at 40,000 sheets and resolution deteriorated | 2.2 | Image smearing occurred |
| Comp.Ex. B-3 | Good | Image smearing occurred at 30,000 sheets and resolution deteriorated | 1.3 | Image smearing occurred |

TABLE 2-continued

| | Initial image evaluation | Result of continuous paper run test: Image evaluation after each 10,000 sheets | Amount of wear after 50,000-sheet test (μm) | Image evaluation after exposure to ozone gas |
|---|---|---|---|---|
| Comp.Ex. B-4 | Good | Image smearing occurred at 30,000 sheets and resolution deteriorated | 1.4 | Image smearing occurred |
| Comp.Ex. B-5 | Good | occurred at 30,000 sheets | 4.8 | Good (unchanged from initial image) |

It is clear from the continuous paper run test results shown in Table 2 that good images were obtained with the photoreceptors containing at least an inorganic filler and binder resin in the outermost surface layer, that is, the photoreceptors of the embodiments in which the copolymer polyarylate resin having the alkylene-aryldicarboxylate structural unit was used as the binder resin, whereas image smearing occurred after repeated copying with the photoreceptors of the comparative examples in which a polycarbonate or ordinary polyarylate was used as the binder resin. It is also seen that the photoreceptors of the present invention exhibit high wear resistance as compared to photoreceptors in which no layer containing inorganic filler is provided in the outermost surface layer. From the results of image degradation tests which involved exposure to ozone gas, it is learned that, as compared to the photoreceptors of the comparative examples in which a polycarbonate or ordinary polyarylate was used as the binder resin, the photoreceptors of the embodiments which used a copolymer polyarylate resin having the alkylene-aryldicarboxylate structural unit exhibit resistance to oxidizing gases.

Accordingly, it is demonstrated that, by having the photoreceptor of the present invention contain, as a binder resin, a copolymer polyarylate resin having an alkylene-aryldicarboxylate structural unit and an inorganic filler in the outermost surface layer thereof, a photoreceptor which exhibits high wear resistance, and high image quality and high durability, without abnormal images occurring, due to image smearing or the like, in repeated copying. In addition, it is also demonstrated that an image forming process, image forming apparatus, and image forming apparatus processing unit in which the photoreceptor of the present invention is used exhibit high performance and high reliability.

Because the photoreceptor of the present invention exhibits high wear resistance, it is possible to form images of high image quality, with no abnormal images caused by reduction in image density or image smearing or the like, even in repeated use over a long period of time.

What is claimed is:

1. An electrophotographic photoreceptor comprising:

an electroconductive substrate; and a photosensitive layer disposed above the electroconductive substrate;

wherein an outermost surface layer of the electrophotographic photoreceptor contains an inorganic filler, binder resin, and aliphatic polyester, and wherein the outermost surface layer of the electrophotographic photoreceptor further contains a polycarboxylic acid compound.

2. The electrophotographic photoreceptor according to claim 1, wherein the aliphatic polyester is a polyester obtained by ring opening polymerization of a cyclic ester.

3. The electrophotographic photoreceptor according to claim 1, wherein the aliphatic polyester is a polycaprolactone.

4. The electrophotographic photoreceptor according to claim 1, wherein the aliphatic polyester is a polyester obtained by polycondensation of an aliphatic dicarboxylic acid and an aliphatic diol.

5. The electrophotographic photoreceptor according to claim 1, wherein the content of the aliphatic polyester is 0.01 to 100 parts by weight based on 100 parts by weight of the inorganic filler.

6. The electrophotographic photoreceptor according to claim 1, wherein amount of the aliphatic polyester contained is 0.1 to 50 parts by weight based on 100 parts by weight of the inorganic filler.

7. The electrophotographic photoreceptor according to claim 1, wherein the outermost surface layer of the electrophotographic photoreceptor further contains a polycarboxylic acid compound which has an acid value of 10 to 400 (mgKOH/g).

8. The electrophotographic photoreceptor according to claim 1, wherein the electrophotographic photoreceptor has a protective layer on the photosensitive layer, and the protective layer is the outermost surface layer.

9. The electrophotographic photoreceptor according to claim 1, wherein the photosensitive layer comprises a charge generating layer and a charge transporting layer in that order from a side of the electroconductive substrate.

10. The electrophotographic photoreceptor of claim 1, wherein said electroconductive substrate comprises a material having a conductivity of volume resistance of $10^{10}\Omega\cdot$cm or less and coated with a metal or a metal oxide.

11. The electrophotographic photoreceptor of claim 1, wherein said electroconductive substrate comprises a electroconductive powder dispersed in an adhesive resin and coated onto a support material.

12. An image forming apparatus comprising:

the electrophotographic photoreceptor of claim 1;

a charger for charging the electrophotographic photoreceptor;

a light irradiator for irradiating the electrophotographic photoreceptor charged by the charger so as to form a latent electrostatic image;

an image developer for developing the latent electrostatic image using a developer so as to form a developed image; and a transfer for transferring the developed image formed by the image developer to a recording material.

13. A detachable processing unit for an image forming apparatus, comprising:

the electrophotographic photoreceptor of claim 1; and at least one means selected from the group consisting of:

(a) means for charging the electrophotographic photoreceptor;

(b) means for developing a latent electrostatic image using a developer so as to form a developed image;

(c) means for transferring the developed image formed by the image developer to a recording material;

(d) means for cleaning the developer remaining on the electrophotographic photoreceptor after the transferring; and (e) means for removing the latent image on the electrophotographic photoreceptor after the transferring.

* * * * *